US006895937B2

(12) United States Patent
Namekawa et al.

(10) Patent No.: US 6,895,937 B2
(45) Date of Patent: May 24, 2005

(54) FUEL INJECTOR AND DIESEL ENGINE COMPRISING THE SAME

(75) Inventors: Shoji Namekawa, Yokohama (JP); Hiroshi Yoshizumi, Yokohama (JP); Hiroyuki Ishida, Nagasaki (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/607,028

(22) Filed: Jun. 27, 2003

(65) Prior Publication Data

US 2004/0055574 A1 Mar. 25, 2004

(30) Foreign Application Priority Data

| | | |
|---|---|---|
| Jul. 1, 2002 | (JP) | P2002-192150 |
| Jul. 1, 2002 | (JP) | P2002-192151 |
| Jul. 18, 2002 | (JP) | P2002-209641 |
| Aug. 21, 2002 | (JP) | P2002-240816 |

(51) Int. Cl.[7] ..... F02M 37/04
(52) U.S. Cl. ..... 123/447; 123/496
(58) Field of Search ..... 123/446, 447, 123/496, 511, 514

(56) References Cited

U.S. PATENT DOCUMENTS

| | | | | |
|---|---|---|---|---|
| 5,146,894 A | * | 9/1992 | Rembold et al. | 123/447 |
| 5,427,066 A | | 6/1995 | Buckley et al. | |
| 5,433,182 A | | 7/1995 | Augustin et al. | |

(Continued)

FOREIGN PATENT DOCUMENTS

| | | |
|---|---|---|
| DE | 41 18 236 | 12/1991 |
| EP | 0 711 914 | 5/1996 |
| EP | 0785356 A2 | 7/1997 |
| EP | 0 959 245 | 11/1999 |
| EP | 0 967 388 | 12/1999 |
| GB | 2 330 871 | 5/1999 |
| JP | 2001-73900 | 3/2001 |
| WO | 95/17594 | 6/1995 |
| WO | 01/04488 | 1/2001 |
| WO | 01/14711 | 3/2001 |
| WO | 01/14737 | 3/2001 |

OTHER PUBLICATIONS

Keiki Tanabe et al., "Fuel Injection Control and Effects on Exhaust Emissions of a Next Generation Common Rail Fuel Injection System", NCRS, No. 13, pp. 44–50, 2001.

*Primary Examiner*—Thomas Moulis
(74) *Attorney, Agent, or Firm*—Wenderoth, Lind & Ponack, L.L.P.

(57) ABSTRACT

A fuel injector can reduce the smoke emissions generated during low load and decrease NOx during high load. The fuel injector comprises a first accumulator for accumulating a pressurized fuel, a second accumulator for accumulating a fuel having a higher pressure than the pressure of the fuel in the first accumulator, fuel injection valves to which the fuel from the first and second accumulators is supplied and thereby the fuel injection valves are opened, and the fuel is injected, fuel feeding pipes for feeding the fuel accumulated in the first and second accumulators to the fuel injection valves; a first valve mechanism which is provided at the fuel feeding pipe and which opens and allows the flow of the fuel in the first accumulator to the fuel injection valves, a second valve mechanism which is provided at the fuel feeding pipe and which opens and allows the flow of the fuel in the second accumulator to the fuel injection valves, and a control device for controlling the first and second valve mechanisms. The first accumulator and the first valve mechanism, and the second accumulator and the second valve mechanism, are provided in parallel to each other to the fuel feeding pipe. In a normal injection mode, the control device makes the first and second valve mechanisms open at the same time. In an injection rate control mode, the control device makes an open timing of the first valve mechanism earlier than an open timing in the normal injection mode.

63 Claims, 15 Drawing Sheets

U.S. PATENT DOCUMENTS 5,642,714 A 7/1997 Buckley
5,727,525 A 3/1998 Tsuzuki
5,732,679 A * 3/1998 Takahasi et al. ..... 123/467
5,746,180 A 5/1998 Jefferson et al.
6,220,224 B1 4/2001 Matthies et al.
6,237,569 B1 5/2001 Stelzer et al.
6,520,152 B1 2/2003 Mahr et al.
6,543,420 B2 * 4/2003 Kohketsu et al. ..... 123/447
6,619,263 B1 9/2003 Otterbach et al.
6,792,919 B2 * 9/2004 Kohketsu et al. ..... 123/447

* cited by examiner

FUEL INJECTOR AND DIESEL ENGINE COMPRISING THE SAME

BACKGROUND OF THE INVENTION

1. Field of the Invention

The present invention relates to a fuel injector and to a diesel engine provided with the fuel injector.

2. Description of the Related Art

As an accumulator fuel injector, a fuel injector comprising one accumulator accumulating a pressurized fuel, fuel injection valves to which the fuel is supplied from the accumulator, and thereby the fuel injection valves are opened and the fuel is injected, fuel feeding pipes for feeding the fuel accumulated in the accumulator to the fuel injection valves, and one valve mechanism which is provided to the fuel feeding pipe and which opens and allows the flow of the fuel in the accumulator to the fuel injection valves.

In the fuel injector, regardless of increase and decrease of a load applied to the fuel injector, a fuel injection rate is substantially fixed during fuel injecting. Therefore, in this fuel injector, smoke emission during low load is reduced due to high injection rate. However, at the early period of a fuel injection during high load, since a large amount of fuel is injected, the amount of NOx contained in exhaust gas increases, and environmental problems may occur. Therefore, countermeasures, which can achieve the reduction in smoke emission during low load and decrease in NOx during high load, have been desired.

In addition, in the diesel engine comprising this fuel injector, when the valve mechanism is broken and the diesel engine does not operate, the diesel engine must be stopped and the valve mechanism must be changed. Therefore, for example, when the diesel engine is used for generating electric power, during the change operation, electric power is temporarily not supplied. In addition, when the diesel engine is a main engine of a ship, the ship is temporarily crippled.

Furthermore, for example, Unexamined Japanese Patent Application, First Publication No. Hei 11-182380 discloses an accumulator fuel injector which controls the fuel injection rate at an early period of a fuel injection. The accumulator fuel injector comprises fuel injection valves each of which comprises a solenoid valve for controlling fuel injection therein, a low pressure accumulator, a high pressure accumulator, and a solenoid valve for changing pressure which opens and allows the flow of fuel from the high pressure accumulator to the fuel injection valves.

In this fuel injector, when the solenoid valve for controlling fuel injection is opened, fuel, which is applied to a hydraulic piston closing a needle valve, is recovered in a fuel tank via a leak pipe. Thereby, the needle valve is pushed upwardly by the fuel in a fuel pool and fuel is injected from a nozzle hole to a combustion chamber. In contrast, when the solenoid valve for controlling fuel injection is closed, the hydraulic piston of the needle valve is pressed, the needle valve is closed. Specifically, at the early period of the fuel injection, the solenoid valve for changing pressure is closed and the solenoid valve for controlling fuel injection is opened, fuel is supplied from the low pressure accumulator to the fuel injection valves. At the later phase of the fuel injection, the solenoid valve for changing pressure and the solenoid valve for controlling fuel injection are both opened, and thereby fuel in the high pressure accumulator is supplied to the fuel injection valves.

In this fuel injector, in order to close the needle valve, it is necessary to close the solenoid valve for controlling fuel injection and to apply fuel pressure to the hydraulic piston. In particular, in medium and large diesel engines using heavy oil as fuel, since heavy oil does not have a fixed viscosity, a time lag from when fuel pressure is applied to the hydraulic piston and to when the needle valve is closed varies, depending on the viscosity of the heavy oil. Due to this, a fuel injection is not completed immediately and late combustion phase becomes worse. Thereby, a problem arises in that an exhaust gas temperature and fuel consumption increase.

SUMMARY OF THE INVENTION

In consideration of the above-described problems with conventional technology, an object of the present invention is to provide a fuel injector and a diesel engine comprising the fuel injector, which can solve both problems in the reduction of the smoke emission during low load and the decrease of NOx during high load.

In addition, in consideration of the above-described problems with conventional technology, another object of the present invention is to provide a fuel injector and a diesel engine comprising the fuel injector, in which the valve mechanism can be changed without the diesel engine being stopped.

Furthermore, in consideration of the above-described problems with conventional technology, another object of the present invention is to provide a fuel injector and a diesel engine comprising the fuel injector, in which a conventional mechanical fuel injection valve which can complete a fuel injection without delay, is used and the fuel injection rate is reliably controlled. That is, the object of the present invention is to provide a fuel injector and a diesel engine comprising the fuel injector, in which a fuel injection valve, which is constrained to the direction leading the needle valve to close by a spring, and when a fixed pressure is applied to the needle valve and the applied pressure is larger than the constrained force, the needle valve is opened, and thereby the fuel injection rate is reliably controlled, can be used.

In order to achieve the objects, the present invention provides the following fuel injectors and the following diesel engines.

That is, in order to achieve the objects, the present invention provides a first fuel injector comprising: a first accumulator for accumulating a pressurized fuel; a second accumulator for accumulating a fuel having a higher pressure than the pressure of the fuel in the first accumulator; fuel injection valves to which the fuel from the first and second accumulators is supplied and thereby the fuel injection valves are opened, and the fuel is injected; fuel feeding pipes for feeding the fuel accumulated in the first and second accumulators to the fuel injection valves; a first valve mechanism which is provided at the fuel feeding pipe and which opens and allows the flow of the fuel in the first accumulator to the fuel injection valves; a second valve mechanism which is provided at the fuel feeding pipe and which opens and allows the flow of the fuel in the second accumulator to the fuel injection valves; and a control device for controlling the first and second valve mechanisms; wherein the first accumulator and the first valve mechanism, and the second accumulator and the second valve mechanism, are provided in parallel to each other to the fuel feeding pipe; wherein in a normal injection mode, the control device makes the first and second valve mechanisms open at the same time; and wherein in an injection rate control mode, the control device makes an open timing of the first valve mechanism earlier than an open timing in the normal injection mode.

In the fuel injector, the first valve mechanism in an injection rate control mode is opened earlier than in a normal injection mode and fuel in the first accumulator is supplied to the fuel injection valves. Then, the second valve mechanism in an injection rate control mode is opened at the same timing as in a normal injection mode and fuel in the second accumulator is supplied to the fuel injection valves. Thereby, in an injection rate control mode, a fuel injection start timing becomes earlier, a fuel injection rate in an early period during a fuel injection decreases, and a fuel injection rate in a late period increases. Due to this, it is possible to decrease the content of NOx in an exhaust gas while a suitable specific fuel consumption is maintained.

In the fuel injector, it is preferable that in the injection rate control mode, the control device make an open timing of the first valve mechanism earlier than the open timing in the normal injection mode, and the control device makes an open timing of the second valve mechanism later than an open timing in the normal injection mode. According to the fuel injector, in an injection rate control mode, a fuel injection start timing becomes earlier. In addition, the injection start timing of the fuel supplied from the second accumulator in an injection rate control mode is later than the injection start timing in a normal injection mode. The fuel injection rate in an early period during a fuel injection decreases, and a fuel injection rate in a late period increases. Due to this, it is possible to reliably decrease the content of NOx in an exhaust gas while a suitable specific fuel consumption is reliably maintained.

In order to achieve the objects, the present invention provides a second fuel injector comprising: a first accumulator for accumulating a pressurized fuel; a second accumulator for accumulating a fuel having a higher pressure than the pressure of the fuel in the first accumulator; fuel injection valves to which the fuel from the first and second accumulators is supplied and thereby the fuel injection valves are opened, and the fuel is injected; fuel feeding pipes for feeding the fuel accumulated in the first and second accumulators to the fuel injection valves; a first valve mechanism which is provided at the fuel feeding pipe and which opens and allows the flow of the fuel in the first accumulator to the fuel injection valves; a second valve mechanism which is provided at the fuel feeding pipe and which opens and allows the flow of the fuel in the second accumulator to the fuel injection valves; and a control device for controlling the first and second valve mechanisms; wherein the first valve mechanism is provided to the fuel feeding pipe downstream of the second valve mechanism in a flow direction of the fuel toward the fuel injection valves; wherein in a normal injection mode, the control device makes the first and second valve mechanisms open at the same time; and wherein in an injection rate control mode, the control device makes an open timing of the first valve mechanism earlier than an open timing in the normal injection mode.

The second fuel injector yields the same effects as those of the first fuel injector. In addition, the fuel supplied from the first and second accumulators to the fuel injection valves can be interrupted by closing only the first valve mechanism. Therefore, an open-closing operation of the valve mechanisms can be simplified.

In the fuel injector, it is preferable that in the injection rate control mode, the control device make an open timing of the first valve mechanism earlier than the open timing in the normal injection mode, and the control device make an open timing of the second valve mechanism later than an open timing in the normal injection mode. According to the fuel injector, in an injection rate control mode, a fuel injection start timing becomes earlier. In addition, the injection start timing of the fuel supplied from the second accumulator in an injection rate control mode is later than the injection start timing in a normal injection mode. The fuel injection rate in an early period during a fuel injection decreases, and a fuel injection rate in a late period increases. Due to this, it is possible to reliably decrease the content of NOx in an exhaust gas while a suitable specific fuel consumption is reliably maintained.

In order to achieve the objects, the present invention provides a third fuel injector comprising a first accumulator for accumulating a pressurized fuel; a second accumulator for accumulating a fuel having a higher pressure than the pressure of the fuel in the first accumulator; fuel injection valves to which the fuel from the first and second accumulators is supplied and thereby the fuel injection valves are opened, and the fuel is injected; fuel feeding pipes for feeding the fuel accumulated in the first and second accumulators to the fuel injection valves; a first valve mechanism which is provided at the fuel feeding pipe and which opens and allows the flow of the fuel in the first accumulator to the fuel injection valves; a second valve mechanism which is provided at the fuel feeding pipe and which opens and allows the flow of the fuel in the second accumulator to the fuel injection valves; and a control device for controlling the first and second valve mechanisms; wherein the first accumulator and the first valve mechanism, and the second accumulator and the second valve mechanism, are provided in parallel to each other to the fuel feeding pipe; wherein in a normal injection mode, the control device makes the first and second valve mechanisms open at the same time; and wherein in an injection rate control mode, the control device makes an open timing of the second valve mechanism later than an open timing in the normal injection mode.

The third fuel injector yields the same effects as those of the first fuel injector.

In order to achieve the objects, the present invention provides a fourth fuel injector comprising a first accumulator for accumulating a pressurized fuel; a second accumulator for accumulating a fuel having a higher pressure than the pressure of the fuel in the first accumulator; fuel injection valves to which the fuel from the first and second accumulators is supplied and thereby the fuel injection valves are opened, and the fuel is injected; fuel feeding pipes for feeding the fuel accumulated in the first and second accumulators to the fuel injection valves; a first valve mechanism which is provided at the fuel feeding pipe and which opens and allows the flow of the fuel in the first accumulator to the fuel injection valves; a second valve mechanism which is provided at the fuel feeding pipe and which opens and allows the flow of the fuel in the second accumulator to the fuel injection valves; and a control device for controlling the first and second valve mechanisms; wherein the first valve mechanism is provided to the fuel feeding pipe downstream of the second valve mechanism in a flow direction of the fuel toward the fuel injection valves; wherein in a normal injection mode, the control device makes the first and second valve mechanisms open at the same time; and wherein in an injection rate control mode, the control device makes an open timing of the second valve mechanism later than an open timing in the normal injection mode.

The fourth fuel injector yields the same effects as those of the first fuel injector. In addition, the fuel supplied from the first and second accumulators to the fuel injection valves can be interrupted by closing only the first valve mechanism. Therefore, an open-closing operation of the valve mechanisms can be simplified.

In the fuel injector, it is preferable for the control device to make the open timing of the first valve mechanism early gradually. According to the fuel injector, since the open timing of the first valve mechanism becomes early gradually, when the fuel injector is provided with cylinders, the combustion conditions, such as the pressure in the cylinders and the temperature of gas exhausted from the cylinders, can be suitably and gradually changed.

In the fuel injector, it is preferable for the control device to make the open timing of the second valve mechanism late gradually. According to the fuel injector, since the open timing of the second valve mechanism becomes late gradually, when the fuel injector is provided with cylinders, the combustion conditions, such as the pressure in the cylinders and the temperature of gas exhausted from the cylinders, can be suitably and gradually changed.

In order to achieve the objects, the present invention provides a fifth fuel injector comprising a first accumulator for accumulating a pressurized fuel; a second accumulator for accumulating a fuel having substantially the same pressure as the pressure of the fuel in the first accumulator; fuel injection valves to which the fuel from the first and second accumulators is supplied and thereby the fuel injection valves are opened, and the fuel is injected; fuel feeding pipes for feeding the fuel accumulated in the first and second accumulators to the fuel injection valves; a first valve mechanism which is provided at the fuel feeding pipe and which opens and allows the flow of the fuel in the first accumulator to the fuel injection valves; a fuel pressure reducing device for reducing the pressure of fuel which passes through the first accumulator and is supplied to the fuel injection valves; a second valve mechanism which is provided at the fuel feeding pipe and which opens and allows the flow of the fuel in the second accumulator to the fuel injection valves; and a control device for controlling the first and second valve mechanisms and the fuel pressure reducing device; wherein, in a normal injection mode, the control device makes the first valve mechanism open earlier than the second valve mechanism; and wherein in an injection rate control mode, the control device operates the fuel pressure reducing device and thereby the pressure of the fuel passing through the first accumulator and supplied to the fuel injection valves is reduced.

In the fuel injector, in an injection rate control mode, the control device make the first valve mechanism open earlier than the second valve mechanism, while the control device operates the fuel pressure reducing device and thereby the pressure of the fuel passing through the first accumulator and supplied to the fuel injection valves is reduced. According to the fuel injector, a fuel injection rate in an early period during a fuel injection decreases, and a fuel injection rate in a late period increases. Due to this, it is possible to decrease the content of NOx in an exhaust gas while a suitable specific fuel consumption is maintained.

In order to achieve the objects, the present invention provides a sixth fuel injector comprising a first accumulator for accumulating a pressurized fuel; a second accumulator for accumulating a fuel having substantially the same pressure as the pressure of the fuel in the first accumulator; fuel injection valves to which the fuel from the first and second accumulators is supplied and thereby the fuel injection valves are opened, and the fuel is injected; fuel feeding pipes for feeding the fuel accumulated in the first and second accumulators to the fuel injection valves; a first valve mechanism which is provided at the fuel feeding pipe and which opens and allows the flow of the fuel in the first accumulator to the fuel injection valves; a fuel pressure reducing device for reducing the pressure of fuel which passes through the first accumulator and is supplied to the fuel injection valves; a second valve mechanism which is provided at the fuel feeding pipe and which opens and allows the flow of the fuel in the second accumulator to the fuel injection valves; and a control device for controlling the first and second valve mechanisms and the fuel pressure reducing device; wherein, in a normal injection mode, the control device makes the first and second valve mechanisms open at the same time; and wherein in an injection rate control mode, the control device makes the open timing of the second valve mechanism later than the open timing in the normal injection mode, while the control device operates the fuel pressure reducing device, and thereby the pressure of the fuel passing through the first accumulator and supplied to the fuel injection valves is reduced.

In the fuel injector, in an injection rate control mode, the control device makes the first valve mechanism open earlier than the second valve mechanism, while the control device operates the fuel pressure reducing device, and thereby the pressure of the fuel passing through the first accumulator and supplied to the fuel injection valves is reduced. The sixth fuel injector can yield the same effects as those of the fifth fuel injector.

In the fuel injector, it is preferable for the first valve mechanism to be provided to the fuel feeding pipe downstream of the second valve mechanism in a flow direction of the fuel toward the fuel injection valves. According to the fuel injector, the fuel supplied from the first and second accumulators to the fuel injection valves can be interrupted by closing only the first valve mechanism. Therefore, an open-closing operation of the valve mechanisms can be simplified.

In the fuel injector, it is preferable for the control device to make the open timings of the first and second valve mechanisms in the injection rate control mode earlier than those of the first and second valve mechanisms in the normal injection mode. According to the fuel injector, the injection timing is adjusted suitably.

In the fuel injector, it is preferable for the control device to make the open timing of the first valve mechanism in the injection rate control mode earlier than that of the first valve mechanism in the normal injection mode. According to the fuel injector, the injection timing is adjusted suitably.

In the fuel injector, it is preferable for the control device to operate the fuel pressure reducing device, and thereby the pressure of the fuel is reduced gradually. According to the fuel injector, since pressure drop by the fuel pressure reducing device is performed gradually, when the fuel injector is provided with cylinders, the combustion conditions, such as the pressure in the cylinders and the temperature of gas exhausted from the cylinders, can be gradually changed.

In order to achieve the objects, the present invention provides a seventh fuel injector comprising at least one accumulator for accumulating a pressurized fuel; fuel injection valves to which the fuel is supplied from the accumulator and thereby the fuel injection valves are opened, and the fuel is injected; fuel feeding pipes for feeding the fuel accumulated in the accumulator to the fuel injection valves; and a least one valve mechanism which is provided to the fuel feeding pipe and which opens and allows the flow of the fuel in the accumulator to the fuel injection valves; wherein a least one flow fuse comprising an excess flow check mechanism is provided between the accumulator and the valve mechanism.

In the fuel injector, the flow fuse comprising an excess flow check mechanism which interrupts flow of fuel when the flow rate of fuel which passes therethrough exceeds a fixed value, that is, when the pressure difference between the upstream side and the downstream side, with respect to the flow fuse, exceeds a fixed value, is provided between the accumulator and the valve mechanism. Therefore, when the valve mechanisms are removed during operation, the excess flow check mechanism of the flow fuse operates and interrupts flow of the fuel. Thereby, the valve mechanisms can be changed without stop of the engine. In addition, if the valve mechanisms are broken, the valve mechanisms can be changed without stopping the engine. Therefore, reliability of the engine can be improved.

In the fuel injector, it is preferable for the accumulator to comprise a first accumulator for accumulating a pressurized fuel and a second accumulator for accumulating a fuel having a higher pressure than the pressure of the fuel in the first accumulator, for the valve mechanism to comprise a first valve mechanism which is provided at the fuel feeding pipe and which opens and allows the flow of the fuel in the first accumulator to the fuel injection valves and a second valve mechanism which is provided at the fuel feeding pipe and which opens and allows the flow of the fuel in the second accumulator to the fuel injection valves, and for the flow fuse to be provided between the first accumulator and the first valve mechanism, and between the second accumulator and the second valve mechanism. The fuel injector can also yield the same effects as those of the seventh fuel injection.

In the fuel injector, it is preferable for the accumulator, the valve mechanism, and the flow fuse to comprise a unit. According to the fuel injector, replacement and maintenance of parts can be carried out at every unit. In addition, since the unit comprising the accumulator, valve mechanism, and flow fuse can be attached to any position of the fixed fuel feeding pipes using joint parts such as high-pressure pipes, this unit can be provided at a suitable position. In addition, maintainability, working efficiency, and reliability can be improved. Furthermore, the fuel injector can be easily provided with a conventional mechanical fuel injection valve, instead of a conventional fuel injection pump.

In the fuel injector, it is preferable for the valve mechanism to comprise another unit, and for the unit comprising the valve mechanism to be detachable from the unit comprising the accumulator and the flow fuse. According to the fuel injector, since only the valve mechanism can be changed, maintainability can be further improved. In addition, the cost for required for maintenance can also be reduced.

In order to achieve the objects, the present invention provides an eighth fuel injector comprising at least one accumulator for accumulating a pressurized fuel; fuel injection valves to which the fuel is supplied from the accumulator and thereby the fuel injection valves are opened, and the fuel is injected; fuel feeding pipes for feeding the fuel accumulated in the accumulator to the fuel injection valves; and a least one valve mechanism which is provided to the fuel feeding pipe and which opens and allows the flow of the fuel in the accumulator to the fuel injection valves; wherein the accumulator comprises at least two accumulators which accumulate fuel at different pressures; wherein the valve mechanism is provided for each of the accumulators; and wherein the valve mechanisms provided for the accumulators accumulating fuel at different pressures are opened, in the order of the lowness of the pressure of the fuel accumulated in the accumulators.

The eighth fuel injector yields the same effects as those of the first fuel injector. In addition, in the eighth fuel injector, a conventional mechanical fuel injection valve, which can complete a fuel injection without delay, can be used, instead of a solenoid valve for controlling fuel injection.

In the fuel injector, it is preferable for the valve mechanism for the accumulator accumulating fuel having the lowest pressure to be provided to the fuel feeding pipe downstream of the other valve mechanisms in a flow direction of the fuel toward the fuel injection valves. According to the fuel injector, the fuel supplied from the accumulators to the fuel injection valves can be interrupted by closing the only one valve mechanism, which is positioned at the most downstream side, that is, the valve mechanism, which is positioned nearest to the fuel injection valves. Therefore, an open-closing operation of the valve mechanisms can be simplified.

In the fuel injector, it is preferable for the accumulator to comprise a first accumulator for accumulating a pressurized fuel and a second accumulator for accumulating a fuel having a higher pressure than the pressure of the fuel in the first accumulator, and for the valve mechanism to comprise a first valve mechanism which is provided at the fuel feeding pipe and which opens and allows the flow of the fuel in the first accumulator to the fuel injection valves and a second valve mechanism which is provided at the fuel feeding pipe and which opens and allows the flow of the fuel in the second accumulator to the fuel injection valves. The fuel injector can reliably yield the same effects as those of the eighth fuel injector.

In the fuel injector, it is preferable for the first valve mechanism to be provided to the fuel feeding pipe downstream of the second valve mechanism in a flow direction of the fuel toward the fuel injection valves. According to the fuel injector, the fuel supplied from the accumulators to the fuel injection valves can be interrupted by closing only the first valve mechanism. Therefore, an open-closing operation of the valve mechanisms can be simplified.

In the fuel injector, it is preferable that a pump for increasing the pressure of fuel to a predetermined value be provided for the accumulator.

In addition, in order to achieve the objects, the present invention provides a diesel engine comprising the fuel injector and cylinder heads provided with the fuel injection valves. According to the diesel engine, since the fuel injector, in which a fuel injection rate in an early period during a fuel injection decreases and a fuel injection rate in a late period increases, is provided, it is possible to decrease the content of NOx in an exhaust gas while a suitable specific fuel consumption is maintained. In addition, in the fuel injector, a fuel injection is completed without delay and afterburning does not occur. Thereby, the temperature of exhaust gas can be reduced, and a fuel consumption ratio decreases.

In the diesel engine, it is preferable for the accumulators and the valve mechanisms to be provided separately from the cylinder heads. When the diesel engine comprises the flow fuse, it is preferable for the accumulator, the valve mechanism, and the flow fuse to be provided separately from the cylinder heads. According to the diesel engine, replacement of parts and maintenance can be easily carried out. In addition, the degree of freedom in the design of a diesel engine increases. Thereby, the size and the weight of a cylinder head or a diesel engine itself can be reduced.

In the diesel engine, it is preferable to comprise a governor for detecting a load of the diesel engine, and for the control device to control the valve mechanisms based on signals from the governor. When the diesel engine comprises the fuel pressure reducing device, it is preferable for the control device to control the valve mechanisms and the fuel pressure reducing device based on signals from the governor. According to the diesel engine, when a load applied to the engine exceeds the fixed value, a normal injection mode changes to an injection rate control mode. In contrast, when a load applied to the engine is less than the fixed value, the reverse change is performed, that is, an injection rate control mode changes to a normal injection mode.

In the fuel injector, it is preferable for the accumulator and the valve mechanism to comprise a unit.

Furthermore, in the fuel injector, it is also preferable for the flow fuse to be provided between the accumulator and the valve mechanism, and for the valve mechanism to be detachable from the accumulator and the flow fuse.

DETAILED DESCRIPTION OF THE PREFERRED EMBODIMENTS

Below, the fuel injector according to the present invention and a diesel engine provided with the same will be explained in further detail with reference to the embodiments.

First Embodiment

Below, a first embodiment of the fuel injector according to the present invention and a diesel engine provided with the same will be explained with reference to FIG. 1 to FIG. 4.

Figure 1:
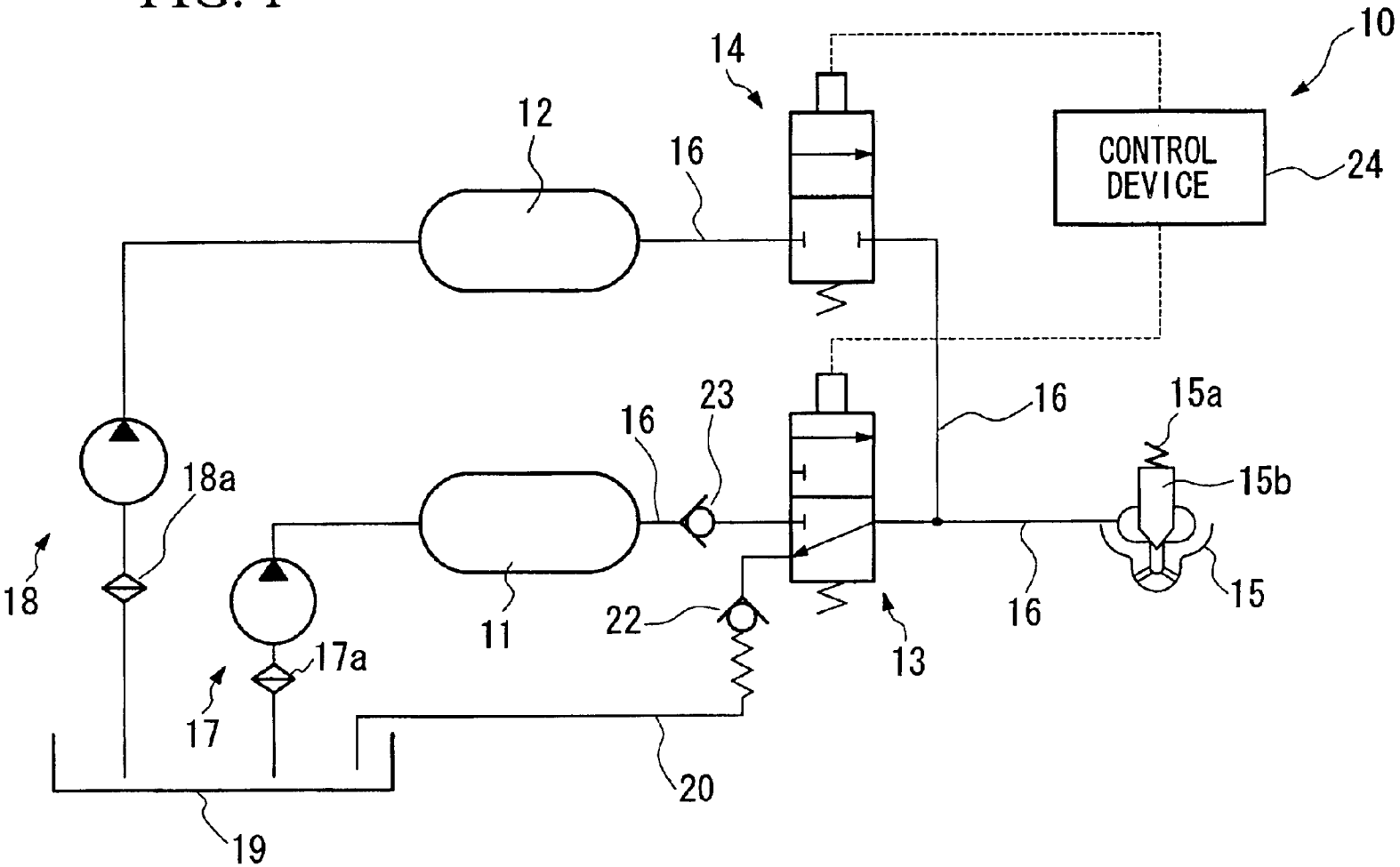
FIG. 1 is a schematic structural diagram showing the first embodiment of the fuel injector according to the present invention.

As shown in FIG. 1, the fuel injector 10 has as essential structural elements a low-pressure accumulator (first accumulator) 11, a high-pressure accumulator (second accumulator) 12, a first control valve (first valve mechanism) 13, a second control valve (second valve mechanism) 14, a fuel injection valve 15, a fuel feeding pipe 16, a first pump 17, a second pump 18, and a control device (control means) 24.

The first accumulator 11 accumulates a fuel, for example, C heavy oil that has been pressurized to, for example, 60 MPa, by the first pump 17.

The second accumulator 12 accumulates a fuel that has been pressurized to, for example, 160 MPa, by the second pump 18.

In the figure, reference numerals 17*a* and 18*a* denote filters that eliminate impurities from the fuel drawn respectively into the first pump 17 and the second pump 18.

In addition, reference numeral 19 denotes a fuel service tank.

A three-way selector valve is used as the first control valve 13. Thereby, the first control valve 13 can supply fuel to the fuel injection valve 15 from the first accumulator 11, and after the fuel supply to the fuel injection valve 15 is stopped, the fuel that remains in the fuel feeding pipe on the fuel injection valve 15 side and has excess pressure can escape to the fuel service tank 19 via the pipe 20 by stopping the fuel supply to the fuel injection valve 15. A two-way delivery valve 22 is provided on the pipe 20. This two-way delivery valve 22 adjusts the fuel pressure in the fuel feeding pipe 16 further upstream so that it does not fall below, for example, 20 MPa.

A two-way delivery valve is used as a second control valve 14. Thereby, it is possible to supply fuel to the fuel injection valve 15 from the second accumulator 12, and it is possible to stop the fuel supply to the fuel injection valve 15.

A check valve 23 is provided on the fuel feeding pipe 16 communicating with the first accumulator 11 and the first control valve 13. This check valve 23 prevents the fuel positioned downstream of the check valve 23 from flowing back in the direction of the first accumulator 11.

The first control valve 13 and the second control valve 14 are what are termed hydraulically actuated valves, that is, they are actuated by the hydraulic oil being supplied from the hydraulic oil tank through the hydraulic oil supply pump, the hydraulic oil supply pipe, and the hydraulic oil pilot valve. The hydraulic oil pilot valve is an electromagnetic valve, and the valve is opened and closed depending on a current flowing to the coil. The control device 24 controls whether a current is flowing or not flowing to the coil. Specifically, whether a current is flowing or not flowing to the coil is controlled by an input signal from the control device 24, and the hydraulic oil is supplied or stopped by the opening and closing of the electromagnetic valve. Thereby, the first control valve 13 and the second control valve 14 control the flow of the fuel.

The fuel injection valve 15 opens when a fuel having a pressure equal to or greater than a predetermined pressure, for example, 45 MPa, is supplied, and injects the fuel into the cylinders. In the fuel injection valve 15, a needle valve 15*a* is urged in the closing direction by a spring 15*a*, and when a predetermined pressure is applied to the needle valve 15*b* from below, the urging force of the spring 15*a* is overcome, and the needle valve 15*b* opens.

Figure 2:
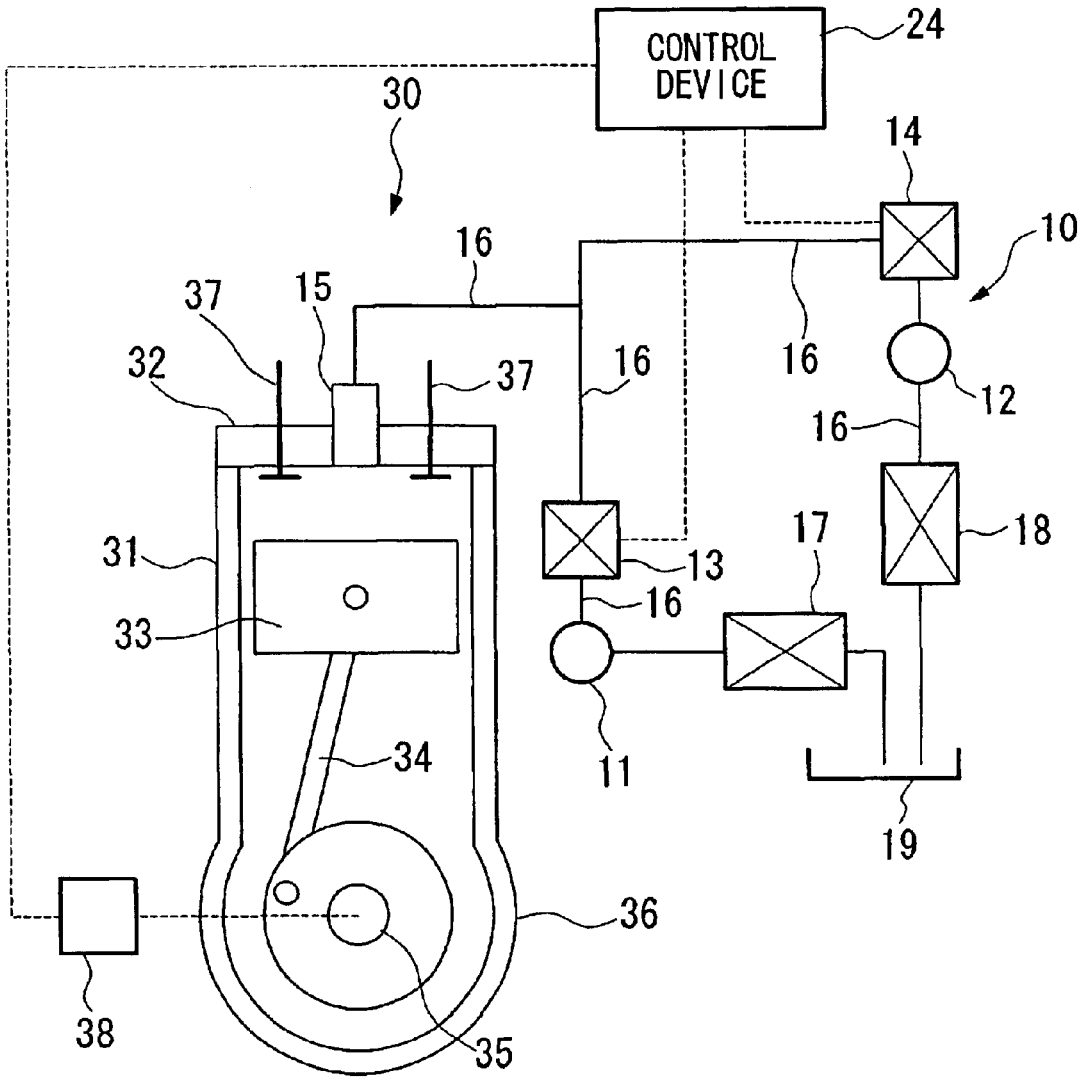
FIG. 2 is a schematic structural diagram showing the first embodiment of the diesel engine comprising the fuel injector shown in FIG. 1.

FIG. 2 is a schematic structural diagram of the reciprocal diesel engine 30 providing this fuel injector 10.

In FIG. 2, reference numeral 31 denotes a cylinder, 32 denotes a cylinder head, 34 denotes a connecting rod, 35 denotes a crank shaft, 36 denotes a crank case, 37 denotes a valve, and 38 denotes a governor.

Moreover, what is termed a diesel engine here is a diesel engine for an electrical power generator, and at 50 Hz, has a rated speed of, for example, 750 cycles, and at 60 Hz, has a rated speed of, for example, 720 cycles.

As shown in FIG. 2, the fuel injection valve 15 is disposed at the approximate center of the cylinder 32. The first accumulator 11, the second accumulator 12, the first control valve 13, and the second control valve 14 are disposed at a distance from the fuel injection valve 15 on the cylinder 31 side. The fuel injection valve 15 is connected to these by a pipe that serves as the fuel feeding pipe 16.

The load information for the diesel engine 30 detected by the governor 38 is sent as a signal to the control device 24.

The action of each part that forms the fuel injector 10 when the diesel engine 30 described above is in operation will now be explained.

Fuel pressurized by the first pump 17 is normally accumulated in the first accumulator 11. Fuel pressurized by the second pump 18 is normally accumulated in the second accumulator 12. The fuel in the first accumulator 11 and the second accumulator 12 is intermittently injected into the fuel injection valve 15 by the following opening and closing action of the first control valve 13 and the second control valve 14.

Figure 3:
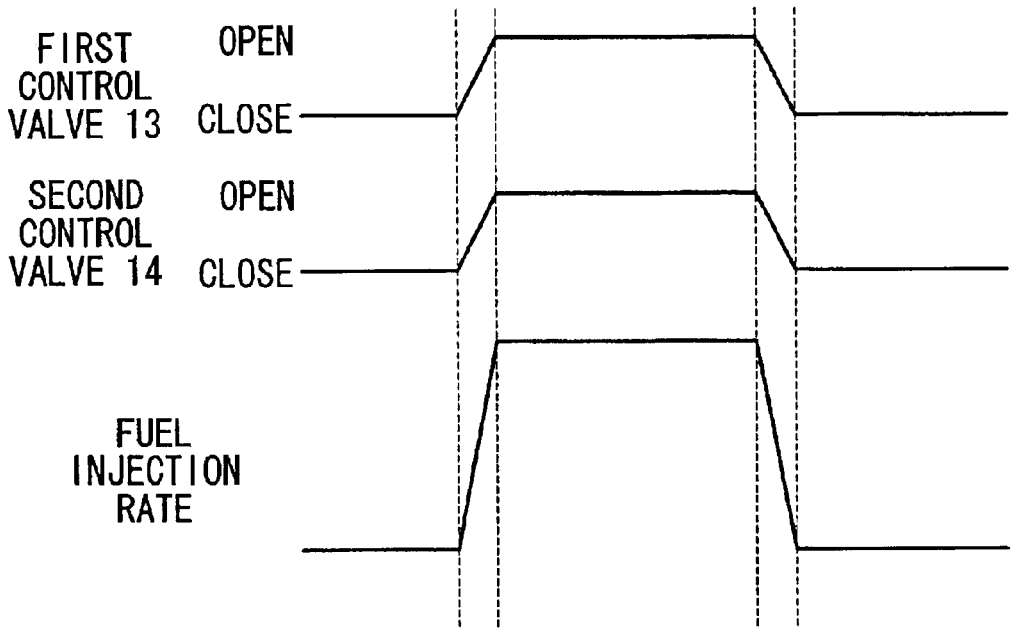
FIG. 3 is a figure showing the operating states of the fuel injector shown in FIG. 1 in a normal injection mode, and shows the fuel injection rate change and the switching conditions of each control valve.

In the case of the normal injection mode, when the diesel engine 30 is operating at a medium load, for example, at a load of 50% or less, as shown in FIG. 3, the first control valve 13 and the second control valve 14 are opened simultaneously. Thereby, the fuel that has accumulated in the first accumulator 11 and the second accumulator 12 is supplied to the fuel injection valve 15 through the first control valve 13 and the second control valve 14. While the fuel is being injected, the fuel injection rate is substantially constant.

Next, when the load on the diesel engine 30 is increased and the engine is operating at a load higher than a medium, the operation transits to injection rate control mode.

Figure 4:
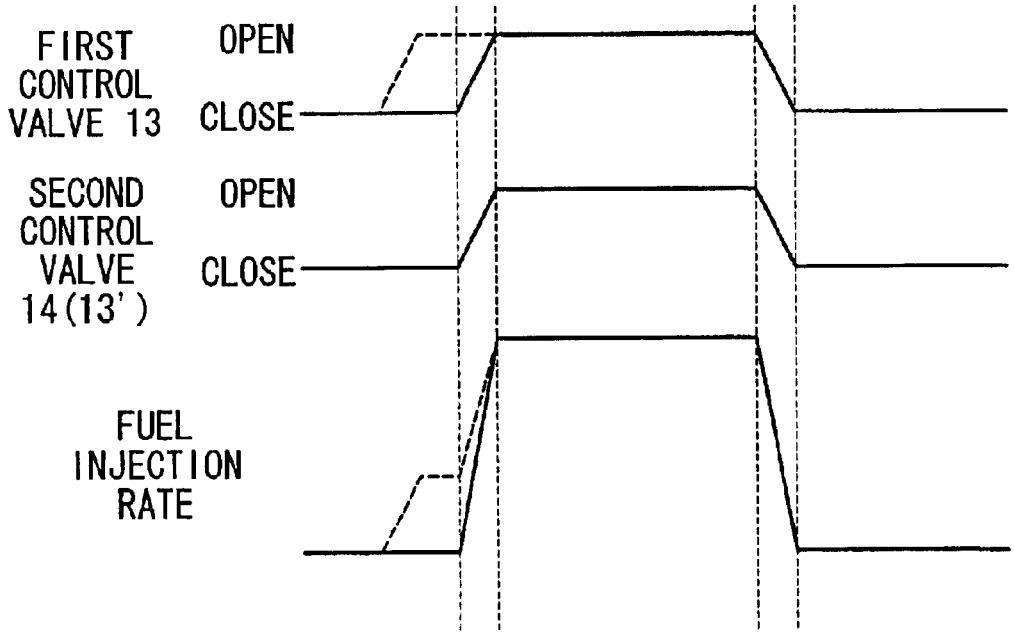
FIG. 4 is a figure showing the operating states of the fuel injector shown in FIG. 1 in an injection rate control mode, and shows the fuel injection rate change and the switching conditions of each control valve.

In the injection rate control mode, as shown by the dashed line in FIG. 4, first the first control valve 13 is opened, and the fuel in the first accumulator 11 is supplied to the fuel injection valve 15. Next, the second control valve 14 is opened at a timing identical to that during the normal fuel operation mode, which is to say, it is opened after a predetermined interval after the opening of the first control valve 13, and the fuel in the second accumulator 12 is supplied to the fuel injection valve 15.

At this time, the check valve 22 is closed because the fuel pressure in the second accumulator 12 is higher than the fuel pressure in the first accumulator 11. Thereby, the high-pressure fuel in the second accumulator 12 is prevented from flowing into the first accumulator 11.

When the injection of the fuel is completed, the first control valve 13 and the second control valve 14 are closed simultaneously. Thereby, the fuel that causes excess pressure due to it remaining in the fuel feeding pipe 16 on the fuel injection valve 15 side is recovered in the fuel service tank 19 through the pipe 20 provided in the first control valve 13.

In this manner, when the first control valve 13 installed on the low-pressure accumulator 11 is opened first, the fuel injection rate of the early period during the fuel injection is restricted to a low rate. Then, when the second control valve 14 installed on the high-pressure accumulator 12 is opened later, the fuel injection rate of the late period is increased. The change in the fuel injection rate during the fuel injection obtained in this manner and the opened and closed state of each of the control valves is shown in by the dashed lines in FIG. 4.

In the diesel engine of the present embodiment, the fuel injection rate of the early period during the fuel injection is restricted to a low rate, and the fuel injection rate of the late period is increased. Thereby, the fuel consumption rate can be advantageously maintained, and it is possible to decrease the NOx in the exhaust gas.

In the present embodiment, the first accumulator 11, the second accumulator 12, the first control valve 13, and the second control valve 14 are formed separately from the fuel injection valve 15, and are provided separated from the cylinder head 32 and the cylinder 31. Therefore, maintenance, parts replacement and the like can be carried out easily. In addition, the degree of freedom in the design of the diesel engine is increased, and it is possible to decrease the size and weight of the cylinder head, the cylinder, and thus the diesel engine as well.

Because a mechanical type fuel injection valve can be used, it can be applied to a cylinder head having a conventional structure.

In the first embodiment described above, as shown in FIG. 4, during injection rate control mode, the first control valve 13 is opened more quickly than during the normal injection mode.

Figure 5:
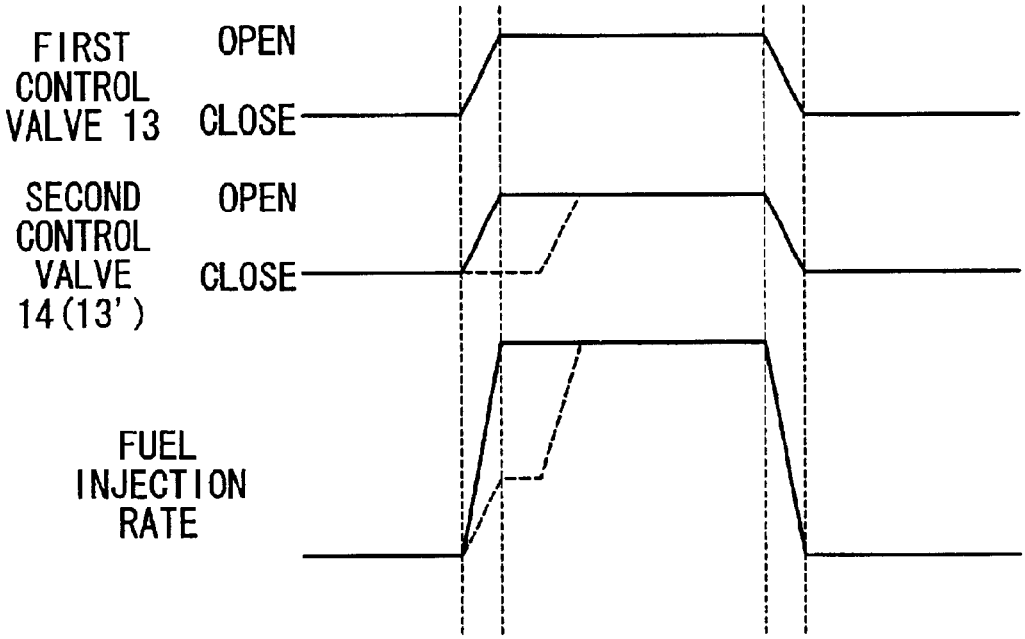
FIG. 5 is a figure showing the other operating states of the fuel injector shown in FIG. 1 in an injection rate control mode and shows the fuel injection rate change and the switching conditions of each control valve.

However, as shown in FIG. 5, even if the period in which the second control valve 14 is opened during the injection rate control mode starts later than the normal injection mode, the same effect is obtained.

Figure 6:
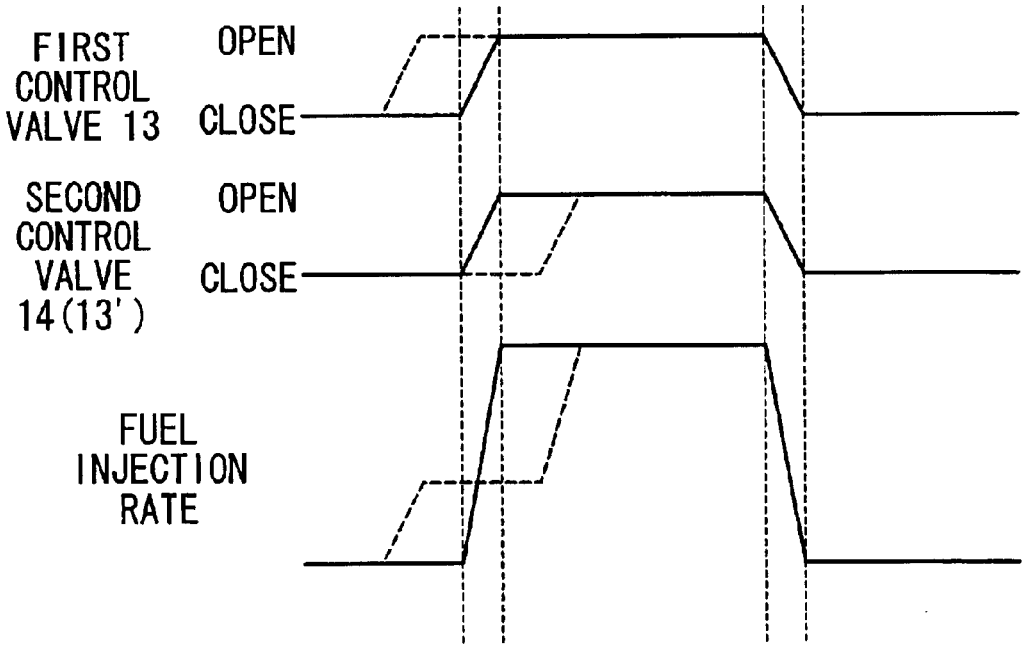
FIG. 6 is a figure showing the other operating states of the fuel injector shown in FIG. 1 in an injection rate control mode and shows the fuel injection rate change and the switching conditions of each control valve.

In addition, the period in which the first control valve 13 is open during the injection rate control mode can be started earlier than the normal injection mode, and the period in which the second control valve 14 is open during the injection rate control mode can be started later than the normal injection mode. This is shown in FIG. 6. Even when the period in which the valve is open is controlled in this manner, the effects described above are obtained.

In addition, when transiting from the normal injection mode to the injection rate control mode, preferably the period in which the first control valve 13 is open is gradually started earlier. In addition, when transiting from the normal injection mode to the injection rate control mode, preferably the period in which the second control valve 14 is open is gradually started later.

Here, "gradually" means that the diesel engine transits, for example, over 50 cycles, not that there is an instantaneous transition from the normal injection mode to the injection rate control mode. Specifically, preferably, the difference between the injection start period during the normal injection mode and the injection start period during the injection rate control mode is divided into 50 equal parts, and each injection start period is started earlier or started later by 1/50 of one cycle. Due to this gradual transition, it becomes possible to avoid sudden changes in the state of the pressure in each cylinder and the temperature of the exhaust gas from each cylinder, that is, changes in the combustion state.

During the transition period from the normal injection mode to the injection rate control mode, preferably the load condition detected by the governor 38 is sent to the control device 24 as a signal, and based on this signal, the control device 24 respectively controls the first control valve 13 and the second control valve 14. Thereby, complete automation can be realized. For example, an electrical power generation facility can be unmanned. In addition, it is possible to switch between the injection rate control mode and the normal injection mode by using a changeover switch provided in the control room that centrally controls a local diesel engine or a plurality of diesel engines.

In the first embodiment described above, the period in which the first control valve 13 and the second control valves 13' and 14 are closed will not be separately explained. In the case in which the amount of the injection fuel is to be decreased on the whole, the period in which these control valves 13 and 14 are closed can be started earlier, and when the amount of the fuel injected is to be increased as a whole, the period in which they are closed can be started later.

Furthermore, the optimal injection start period for the first control valve 13 and the second control valve 14 is determined such that the combustion state is most favorable during a high load and such that the NOx is maximally reduced based on the highest pressure in each valve and the temperature of the exhaust gas discharged from each valve, which are measured in advance in the factory. These are stored in advance in the control device 24 before delivery.

Moreover, in the present embodiment, pumps are provided for each of the accumulators, but the present invention is not limited thereby. For example, the first pump 17 provided on the low-pressure side accumulator 11 can be eliminated, and the pressurized fuel can be supplied to the first accumulator 11 from the pump 18 provided on the high-pressure accumulator 12 via a pressure reducing device such as a pressure reducing valve or orifice.

In addition, in the present embodiment, after the first control valve 13 and the second control valve 14 are closed, the fuel that causes excess pressure due to it remaining in the fuel feeding pipe 16 on the fuel injection valve 15 side can be recovered in the fuel service tank 19 through the pipe 20, but it can also be recovered in a fuel drain tank.

Furthermore, in the present embodiment, the first control valve 13 and the second control valve 14 are hydraulically actuated valves, but an electromagnetic valve can also be used, and any type is suitable as long as possible to carry out the switching of the pipes described above. However, when using, for example, C heavy oil, which has a high viscosity and is heated during usage, as the fuel, preferably a hydraulically actuated valve is used. When using an electromagnetic valve with heated C heavy oil and the like, there are concerns that the resin for fastening the solenoid will dissolve, malfunctioning of the wiring will be caused by the heat, and damage due to heat will occur.

In the present embodiment, the transition from the injection rate control mode to the normal injection mode was not explained. The explanation has been omitted because the transition can be obtained by carrying out the operations described above in reverse.

Second Embodiment

The second embodiment of the present invention will be explained with reference to FIG. 7. Moreover, essential components that have already been explained in the first embodiment have identical reference numerals, and their explanation has been omitted.

Figure 7:
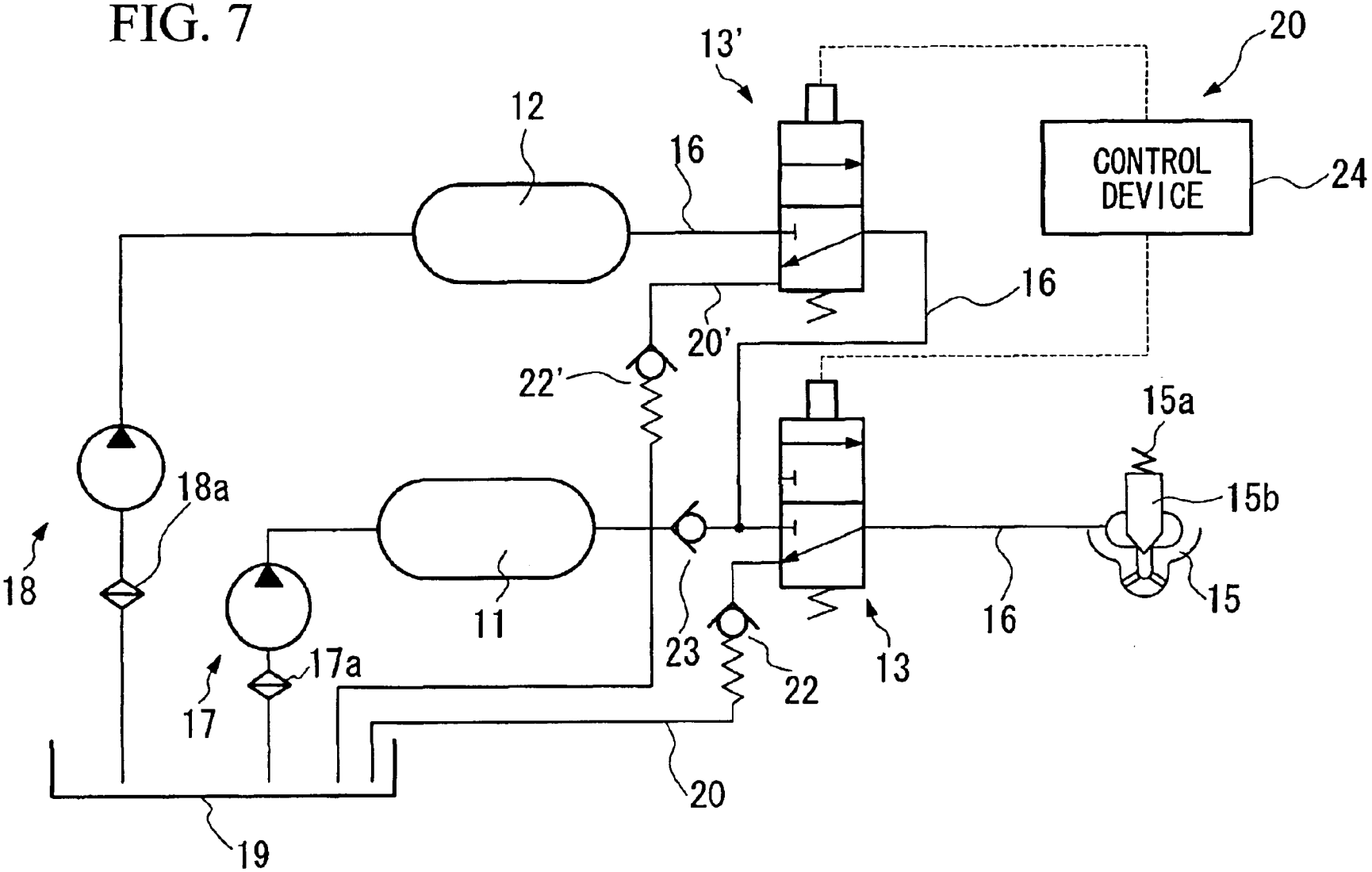
FIG. 7 is a schematic structural diagram showing the second embodiment of the fuel injector according to the present invention.

The second embodiment shown in FIG. 7 differs significantly from the first embodiment in the point that a three-way selector valve identical to that of the first control valve 13 shown in the first embodiment is used as a second control valve 13', which is the high-pressure control valve, and the point that the fuel feeding pipe 16 on the outlet side (the fuel injection valve 15 side) of the second control valve 13' is connected upstream in the direction of the flow of fuel towards the fuel injection valve of the first control valve 13, that is, between the check valve 23 and the first control valve 13.

Note that in the first embodiment, the fuel feeding pipe 16 on the outlet side of the second control valve 14 is connected downstream of the first control valve 13, that is, between the first control valve 13 and the fuel injection valve 15.

The pipe 20' is connected to the second control valve 13', and furthermore, the fuel service tank 19 is provided downstream of the pipe 20. Thus, when the second control valve 13' stops the fuel supply to the fuel injection valve 15, the fuel that causes excess pressure due to it remaining in the fuel feeding pipe 16 on the fuel injection valve 15 side is recovered in the fuel service tank 19 via the pipe 20'.

A two-way delivery valve 22 is also provided on this pipe 20', and the fuel pressure in the drain discharge pipe 20' upstream of the two-way delivery valve 22' and in the fuel feeding pipe 16 is adjusted so as not to become lower than, for example, 20 MPa.

Unlike the first embodiment described above, in the present embodiment, because the first control valve 13 is positioned downstream in the direction of flow of fuel towards the fuel injection valve 15 of the second control valve 13', even if the second control valve 13' closes later then the first control valve 13, the supply of fuel to the fuel injection valve 15 is completely stopped by the closing of the first control valve 13.

Therefore, in this second embodiment, in addition to obtaining effects identical to those of the first embodiment described above, it is not always necessary for the first control valve 13 and the second control valve 13' to close simultaneously, and it is possible for the second control valve 13' to close later than the first control valve 13. Thereby, the effect is obtained that the opening and closing control of the first control valve 13 and the second control valve 13' can be simplified.

Third Embodiment

The third embodiment of the present invention will be explained with reference to FIG. 8 through FIG. 10. Moreover, essential components that have already been explained in the first embodiment have identical reference numerals, and their explanation has been omitted.

The present embodiment differs significantly from the first embodiment in the point that an inlet throttling valve (a fuel pressure reducing device) is provided as a main structural component.

In the present embodiment, the first accumulator 11 accumulates fuel pressurized, for example, to 160 MPa by the first pump 17, and the second accumulator 12 accumulates fuel (C heavy oil) pressurized, for example, to 160 MPa by the second pump 18.

Figure 8:
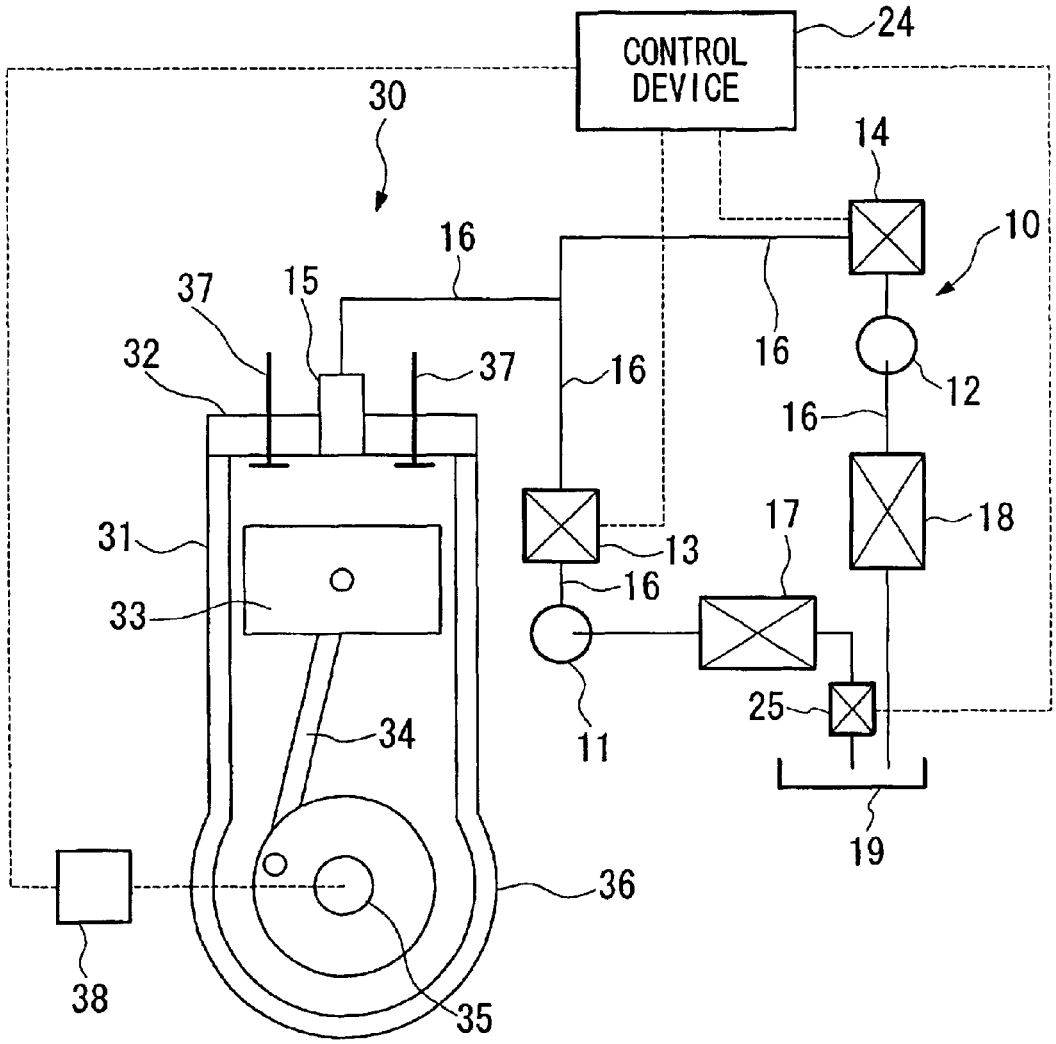
FIG. 8 is a schematic structural diagram showing the third embodiment of the diesel engine according to the present invention.

The reciprocal diesel engine 30 in the present embodiment is shown in FIG. 8.

As shown in FIG. 8, the inlet throttling valve 25 that characterizes the present embodiment is a flow regulating valve provided upstream of the first pump 17, that is, between the filter 17*a* and the first pump 17, and its action is controlled by the control device 24 described above.

When the opening of the inlet throttling valve 25 narrows due to a signal from the control device 24, the rate of flow of fuel that flows into the first pump 17 is decreased, and thus the fuel pressure in the first accumulator 11 decreases.

The operation of the fuel injector 10 when the diesel engine 30 described above is in operation will now be explained below.

Figure 9:
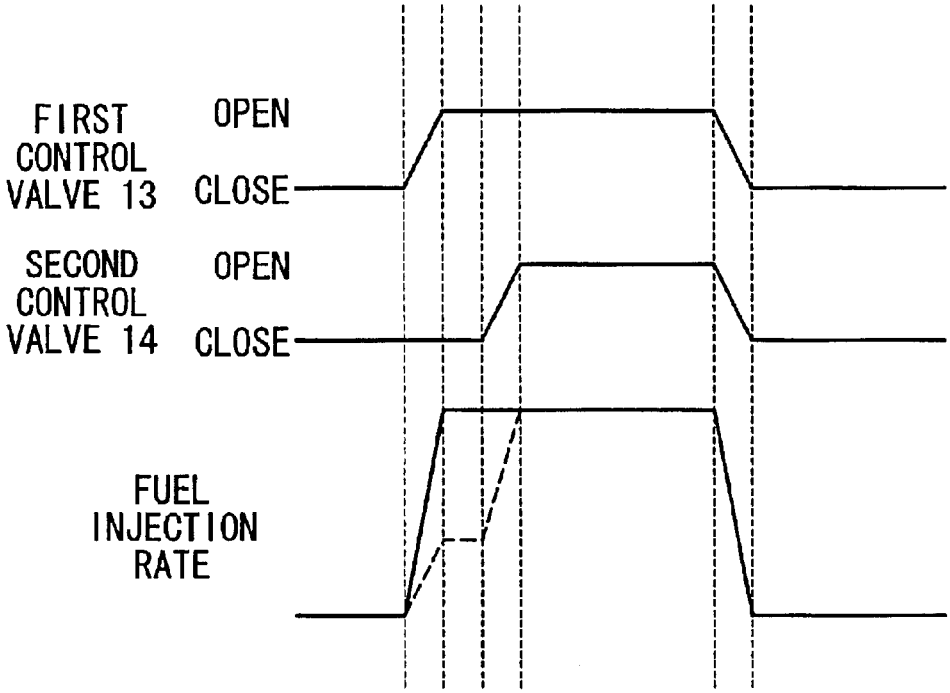
FIG. 9 is a figure showing the operating states of the fuel injector provided with the diesel engine shown in FIG. 8 in a normal injection mode (indicated by a solid line) and an injection rate control mode (indicated by a dashed line), and shows the fuel injection rate change and the switching conditions of each control valve.

The normal injection mode, wherein the diesel engine 30 operating at a medium load, for example, equal to or less than 50%, is shown by the solid lines in FIG. 9. In the normal injection mode, as shown by the solid line in FIG. 9, the first control valve 13 is opened, and then the second control valve 14 is opened. Subsequently, the first control valve 13 and the second control valve 14 are closed simultaneously.

Because the pressure of the fuel in the first accumulator 11 and the pressure of the fuel in the second accumulator 12 are substantially identical, while fuel is being injected, the injection rate is substantially constant.

Next, the load of the diesel engine 30 is increased, and the engine operates at a load heavier than a medium load (a heavy load). That is, the operation transits from the normal injection mode to the injection rate control mode.

In the injection rate control mode of the present embodiment, the timing of the opening and closing of the first control valve 13 and the second control valve 14 is the same as the normal injection mode, a signal is sent from the control device 24 to the inlet throttling valve 25, and the opening of the inlet throttling valve 25 is narrowed. When the opening of the inlet throttling valve 25 is narrowed, the rate of flow of the fuel flowing into the first pump 17 is decreased, and thus the fuel pressure in the first accumulator 11 decreases. When shown graphically, the fuel injection rate at this time is as shown by the dashed line in FIG. 9.

When the injection of the fuel has been completed, the first control valve 13 and the second control valve 14 close simultaneously. Thereby, the fuel that causes excess pressure due to it remaining in the fuel feeding pipe 16 on the fuel injection valve 15 side is recovered in the fuel service tank 19 via the pipe 20 provided in the first control valve 13.

In this manner, when the fuel pressure decreases in the first accumulator 11 positioned upstream of the first control valve 13 that has been opened in advance, as shown in FIG. 9, the fuel injection rate of the early period of one charging stroke is restricted to a low rate, and the fuel injection rate of the late period increases.

Therefore, in the present embodiment, like the first embodiment described above, the fuel injection rate of the early period during the fuel injection is restricted to a low rate, the fuel injection rate of the late period increases, and thus the fuel consumption rate can be advantageously maintained, and the NOx in the exhaust gas can be reduced.

Figure 10:
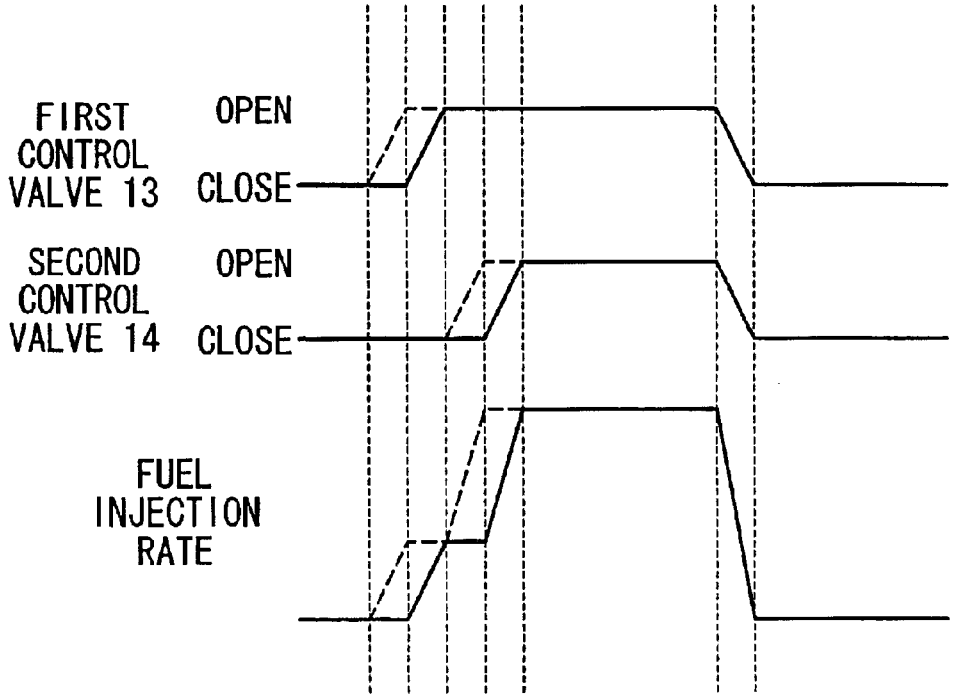
FIG. 10 is a figure showing the operating states of the fuel injector provided with the diesel engine shown in FIG. 8 in an injection rate control mode, the solid line indicates the fuel injection rate change and the switching conditions of each control valve when the fuel injection timing in a normal injection mode equals to the fuel injection timing of an injection rate control mode, and the a dashed line indicates the fuel injection rate change and the switching conditions of each control valve when the fuel injection timings of the first and second control valves in a normal injection mode are earlier than those of the first and second control valves in an injection rate control mode.

In the present embodiment, the injection start period of the fuel during the normal injection mode and the injection rate control mode is the same, but when injection delay becomes a problem during the injection rate control mode, as shown by the dashed line in FIG. 10, the opening of the inlet throttling valve 25 is narrowed, and at the same time, the timing for the opening of the first control valve 13 and the second control valve 14 is preferably started earlier than the normal injection mode (shown by the solid line in FIG. 10).

Fourth Embodiment

Next, a fourth embodiment of the present invention will be explained with reference to FIG. 11. Moreover, essential components that have already been explained in the first embodiment have identical reference numerals, and their explanation has been omitted.

Figure 11:
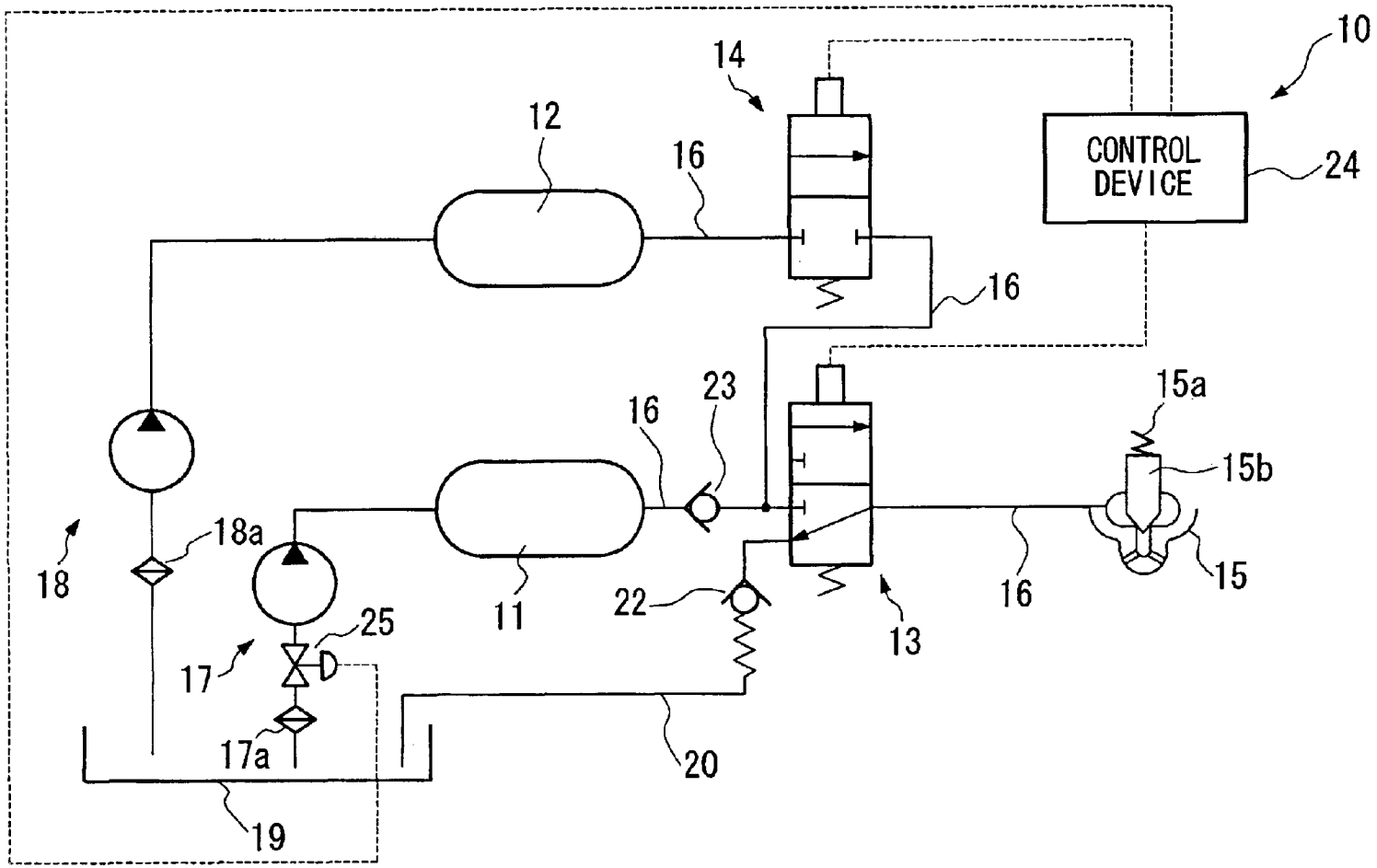
FIG. 11 is a schematic structural diagram showing the fourth embodiment of the fuel injector according to the present invention.

The fourth embodiment shown in FIG. 11 differs significantly from the third embodiment in the point that the fuel feeding pipe 16 on the outlet side of the second control valve 14 is connected upstream of the first control valve 13, that is, between the check valve 23 and the first control valve 13.

Note that in the third embodiment, the fuel feeding pipe 16 on the outlet side of the second control valve 14 is connected downstream of the first control valve 13, that is, between the first control valve 13 and the fuel injection valve 15.

The fuel injector 20 works identically to the third embodiment described above when the diesel engine 30 providing the fuel injector 20 having the structure described above is in operation. Therefore, the present embodiment also yields effects identical to those of the third embodiment described above.

Furthermore, unlike the first embodiment described above, in the present embodiment, because the first control valve 13 is positioned downstream of the second control valve 14, even if the second control valve 14 closes later than the first control valve 13, the supply of fuel to the fuel injection valve 15 is completely stopped by the closing of the first control valve 13.

Therefore, it is not always necessary for the first control valve 13 and the second control valve 14 to close simultaneously, and thus the second control valve 14 can close later than the first control valve 13. Therefore, the opening and closing control of the control valves 13 and 14 can be simplified.

Moreover, in the third and fourth embodiments described above, during normal injection mode the second control valve 14 is opened later than the first control valve 13, but the invention is not limited thereto. It is also possible to open and close only the first control valve 13 while leaving the second control valve 14 closed. In this case, during the transition from the normal injection mode to the injection rate control mode, preferably, first, the second control valve 14 is opened later than the first control valve 13, and at the same time, the inlet throttling valve 25 is actuated.

In addition, in the third and fourth embodiments, an inlet throttling valve 25 is provided upstream of the first pump 17

(the fuel service tank 19 side) as a fuel pressure reducing device. However, the present invention is not limited thereby. The inlet throttling valve 25 can be provided between the first pump 17 and the first accumulator 11 or between the first accumulator 11 and the check valve 23.

Furthermore, as explained above, pressurizing pumps do not need to be provided for each of the accumulators. For example, it is possible to omit the first pump 17, the filter 17*a*, and the inlet throttling valve 25 that are connected to the first accumulator 11. In this case, fuel is supplied to the first accumulator 11 from the second pump 18 connected to the second accumulator 12. In this case, the inlet throttling valve 25 is provided between the second pump 18 and the first accumulator 11.

Fifth Embodiment

Figure 12:
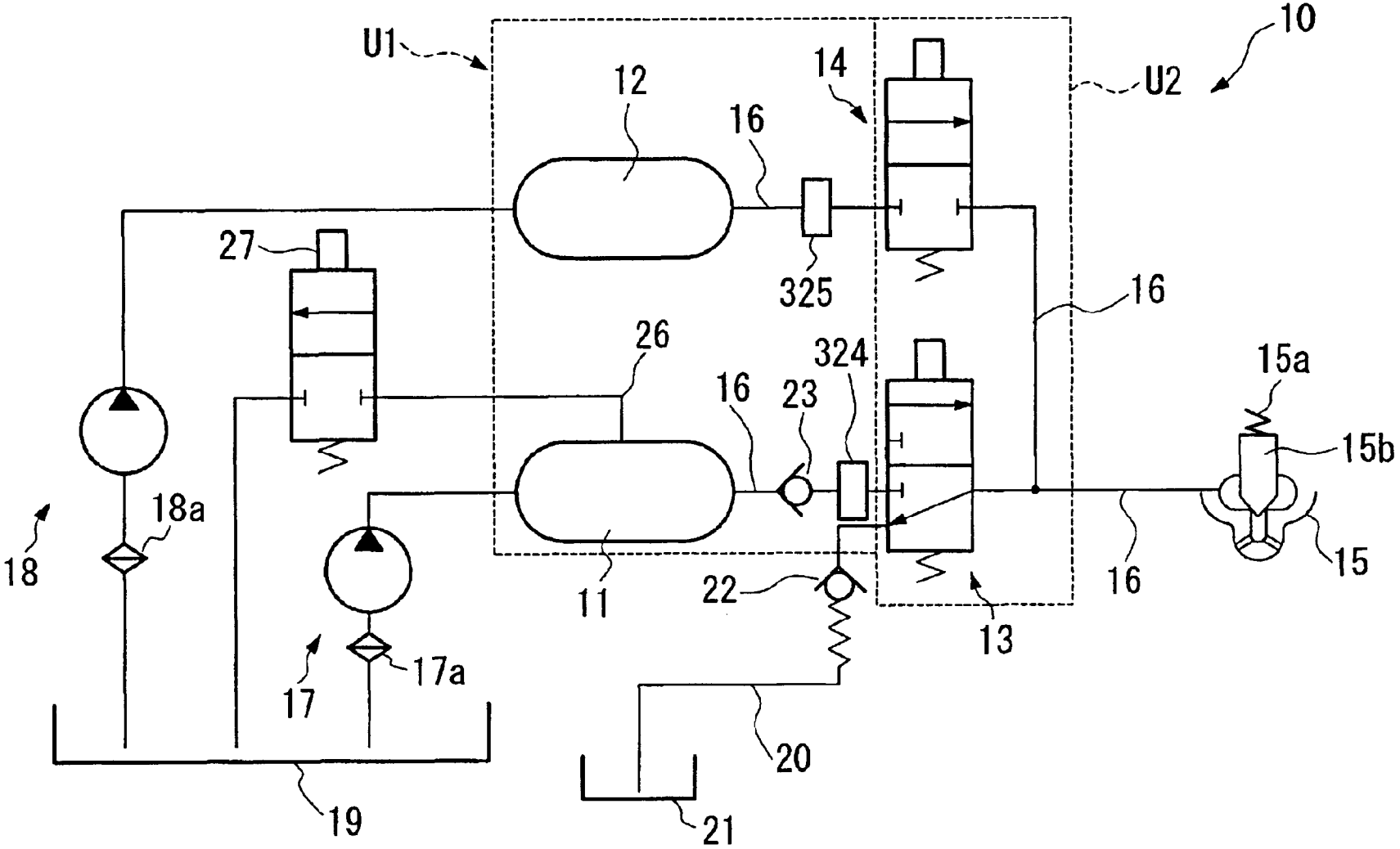
FIG. 12 is a schematic structural diagram showing the fifth embodiment of the fuel injector according to the present invention.

Below, a fifth embodiment of the present invention will be explained with reference to FIG. 12 and FIG. 13. Moreover, essential components that have already been explained in the first embodiment have identical reference numerals, and their explanation has been omitted.

The fifth embodiment differs significantly from the first embodiment in the point that the flow fuses 324 and 325 are provided as main elements, and on the point that a relief valve 27 is provided on the communicating pipe 26 that communicates with the first accumulator 11 and the fuel service tank 19.

In the present embodiment, the first accumulator 11, which is the low-pressure accumulator, accumulates fuel, for example, C heavy oil, pressurized to, for example, 60 MPa by the first pump 17, and the second accumulator 12, which is the high-pressure accumulator, accumulates fuel pressurized to, for example, 160 MPa by the second pump 18.

The flow fuses 324 and 325 have an excess outflow safety mechanism that stops the passage of fuel when the fuel passing through the inside exceeds a certain rate of flow (i.e., the difference between the upstream pressure and the downstream pressure exceeds a predetermined value). The flow fuses 324 and 325 are provided respectively between the first and second accumulators 11 and 12, and the first and second valve mechanisms 13 and 14.

In addition, a relief valve 27 is provided on the communicating pipe 26 that communicates with the first accumulator 11 and the fuel service tank 19.

Figure 13:
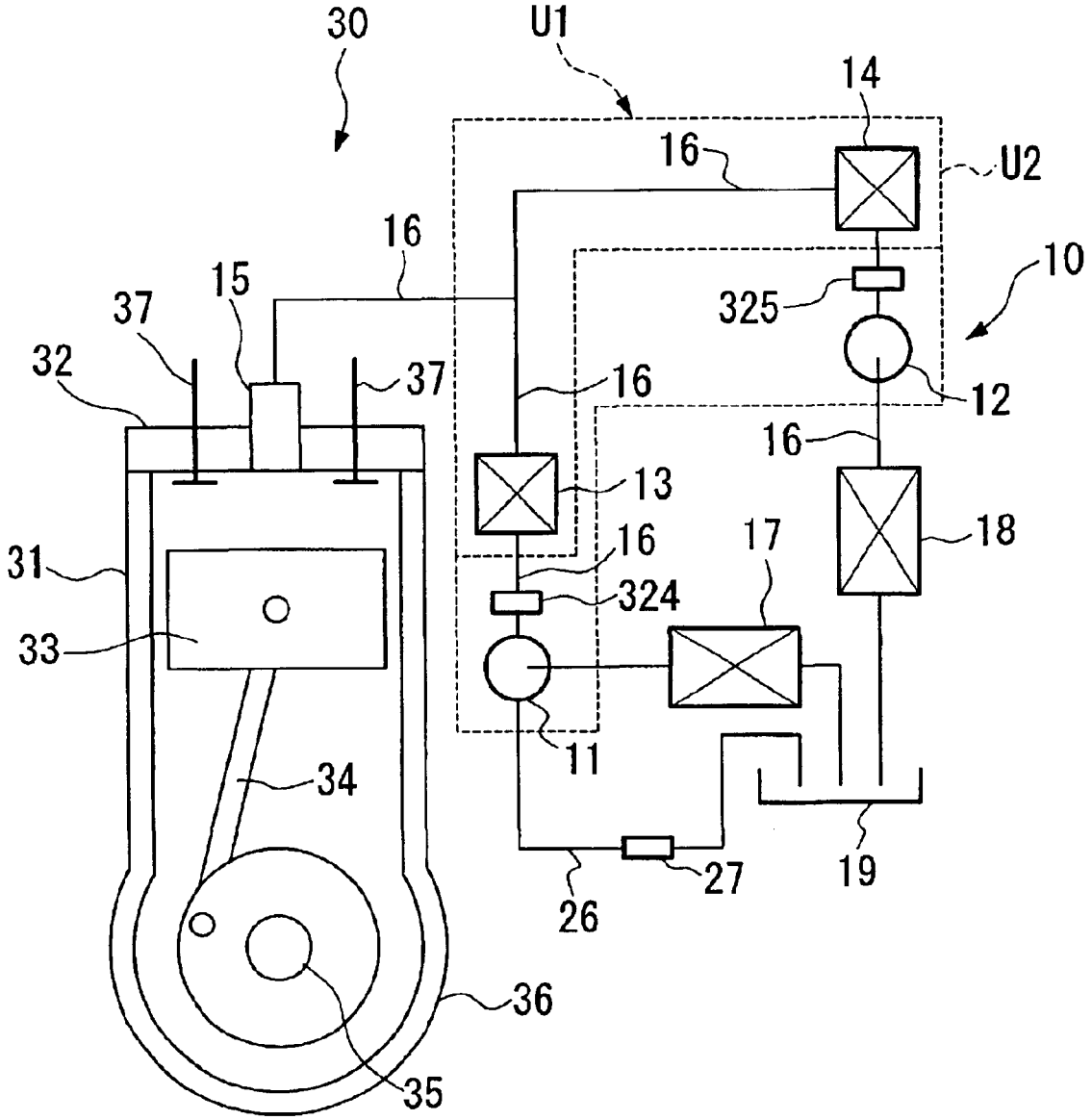
FIG. 13 is a schematic structural diagram showing the diesel engine provided with the fuel injector shown in FIG. 12.

FIG. 13 is a schematic structural diagram of the reciprocal diesel engine 30 providing this fuel injector 10.

As shown in FIG. 13, the fuel injection valve 15 is provided at the approximate center of the cylinder head 32. The first accumulator 11, the second accumulator 12, the first control valve 13, the second control valve 14, and the flow fuses 324 and 325 are disposed by being divided between the cylinder head 32 side and the cylinder 31 side as one unit U1. Both are connected, for example, by a high-pressure pipe that acts as a fuel feeding pipe 16.

In this manner, because the first accumulator 11, the second accumulator 12, the first control valve 13, the second control valve 14, and the flow fuses 324 and 325 are formed as one unit U1 separately from the fuel injection valve 15. That is, since the unit U1 is provided separately from the cylinder head 32 and the cylinder 31, each unit U1 can be replaced, and thereby the operability is improved.

In addition, the degree of freedom in the design of the diesel engine is increased, and it is possible to decrease the size and weight of the cylinder head, the cylinder, and thus the diesel engine as well.

It is possible to attach this unit in place of the fuel injection pump used by a conventional mechanical fuel injection valve, and this fuel injector can be easily mounted.

Furthermore, the first control valve 13 and the second control valve 14 form the unit U2, and the unit U2 is installed freely detachably on the unit U1. Therefore, the first control valve 13 and the second control valve 14 can be separated from the first accumulator 11, the second accumulator 12, and the flow fuses 324 and 324.

By being structured in this manner, the first control valve 13 and the second control valve 14 can be replaced using the following procedure even while the engine is in operation.

First, the hydraulic oil supply pump provided on the hydraulic oil supply pipe is closed by stopping the action of the electromagnetic valves of the first control valve 13 or the second control valve 14, whichever is to be replaced.

Then a fastening member such as a bolt that fastens the unit U2 comprising the first control valve 13 and the second control valve 14 to the first accumulator 11, the second accumulator 12, and the flow fuses 324 and 325 is removed, and the unit U2 formed by the first control valve 13 and the second control valve 14, is removed from the first accumulator 11, the second accumulator 12, and the flow fuses 324 and 325. At this time, because the fuel passing through the flow fuses 324 and 325 exceeds a certain rate of flow, the supply of the fuel is stopped. That is, fuel is not supplied to the cylinder connected to the unit U2, but fuel is supplied to all other cylinders. This means that a reduced cylinder operation condition is established.

Next, the new unit U2 or the unit U2 that has been serviced is installed using the fastening member.

After completion of the installation, the relief valve 27 provided along the communicating pipe 26 that communicates with the first accumulator 11 and the fuel service tank 19 is opened, and thereby the fuel pressure in the first accumulator 11 is lowered. Thereby, the difference between the upstream pressure and the downstream pressure in the flow fuse 324 provided between the first accumulator 11 and the first control valve 13 is made equal to or less than a set value, and the flow fuse 324 is restored. Because the fuel pressure in the first accumulator 11 is decreased, the fuel supply rate to the other cylinders is decreased, and thus the fuel injection rate as a whole is reduced. Therefore, in order to augment this decrease in the fuel injection rate, the period in which the first control valve 13 and the second control valve 14 are open must be started earlier.

When the flow fuse 324 provided between the first accumulator 11 and the first control valve 13 has been restored, the relief valve 27 closes, and the fuel pressure in the first accumulator 11 is restored to the normal value.

Then, the previously closed hydraulic oil supply valve is opened, and the action of the electromagnetic valve is restored. When the action of the electromagnetic valve is restored, the first control valve 13 and the second control valve 14 are both opened. Then, fuel pressure is added from the first accumulator 11 downstream of the flow fuse 325 provided between the second accumulator 12 and the second control valve 14, the difference between the upstream pressure and the downstream pressure in the flow fuse 325 falls below a set value, and the flow fuse 325 is restored. Thereby, the replacement operation is completed.

In the present embodiment, the unit U2 comprising the first control valve 13 and the second control valve 14 can be replaced without stopping the engine. Therefore, even if the first control valve 13 and/or the second control valve 14 were to be broken, it is possible to avoid stopping the engine, and thus it is possible to increase the reliability of the engine.

Moreover, in the present embodiment, there are two of each of the accumulators, control valves, and flow fuses. However, the present invention is not limited thereto. It is possible to use one accumulator, control valve, and flow fuse. For example, the first control valve 13 can serve as the unit U2, and the unit U2 can be made freely detachable from the accumulator 11 and the flow fuse 324. In this case, preferably an accumulator that can be pressurized to 160 MPa is used as the accumulator.

Sixth Embodiment

Below, a sixth embodiment of the present invention will be explained with reference to FIG. 14 to FIG. 16. Moreover, essential components that have already been explained in the first embodiment have identical reference numerals, and their explanation has been omitted.

Figure 14:
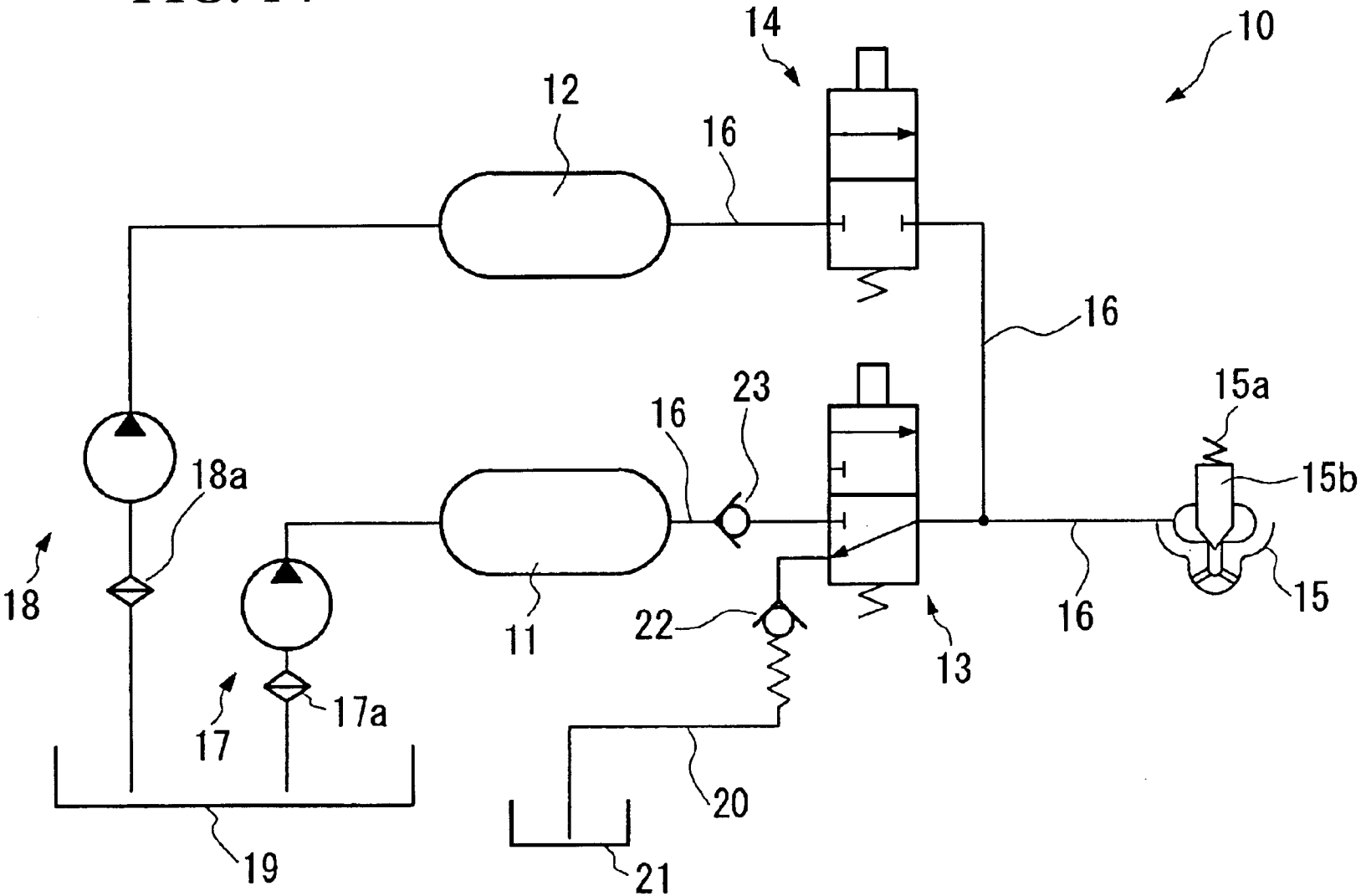
FIG. 14 is a schematic structural diagram showing the sixth embodiment of the fuel injector according to the present invention.
Figure 15:
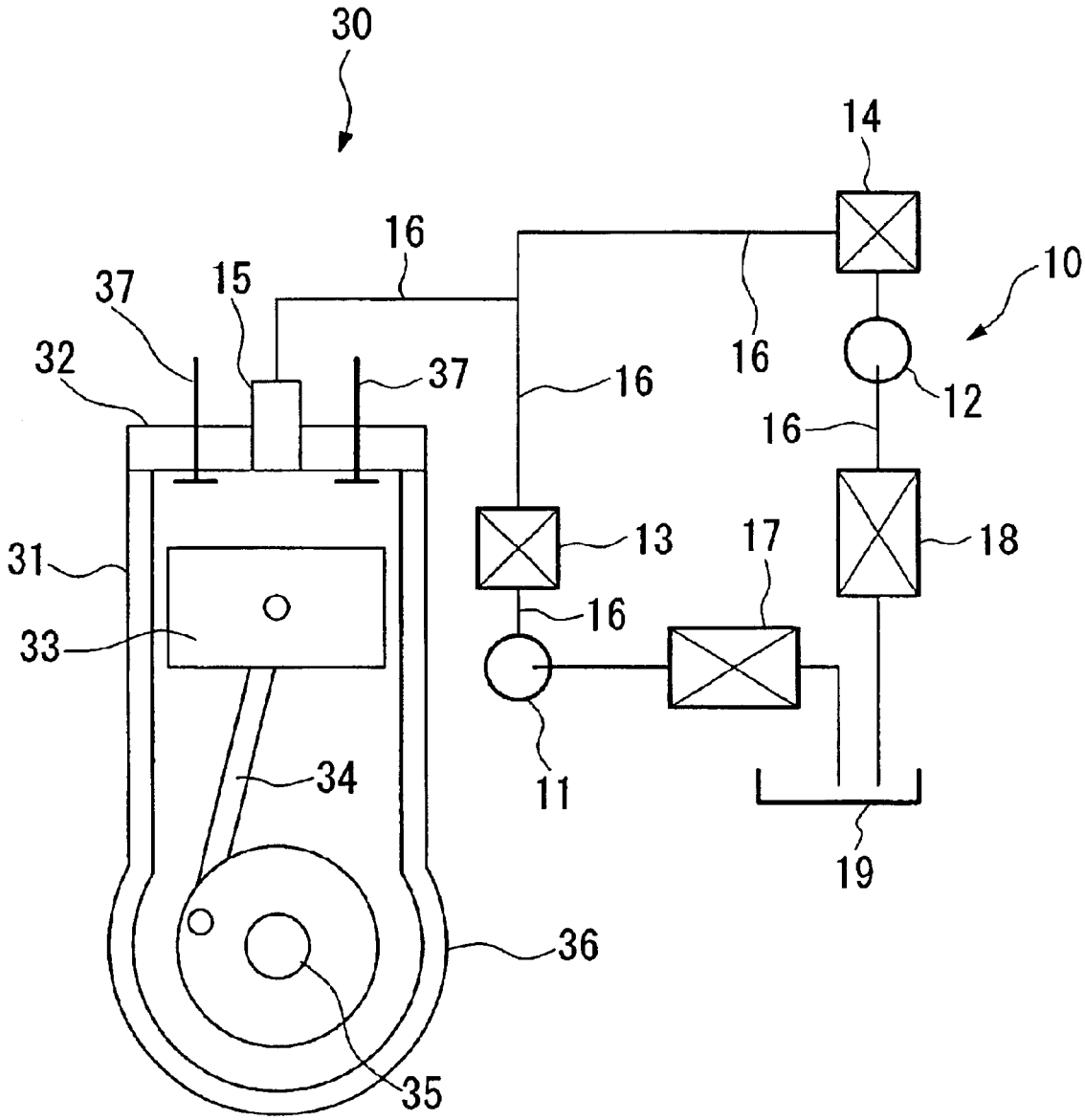
FIG. 15 is a schematic structural diagram showing the diesel engine provided with the fuel injector shown in FIG. 14.
Figure 16:
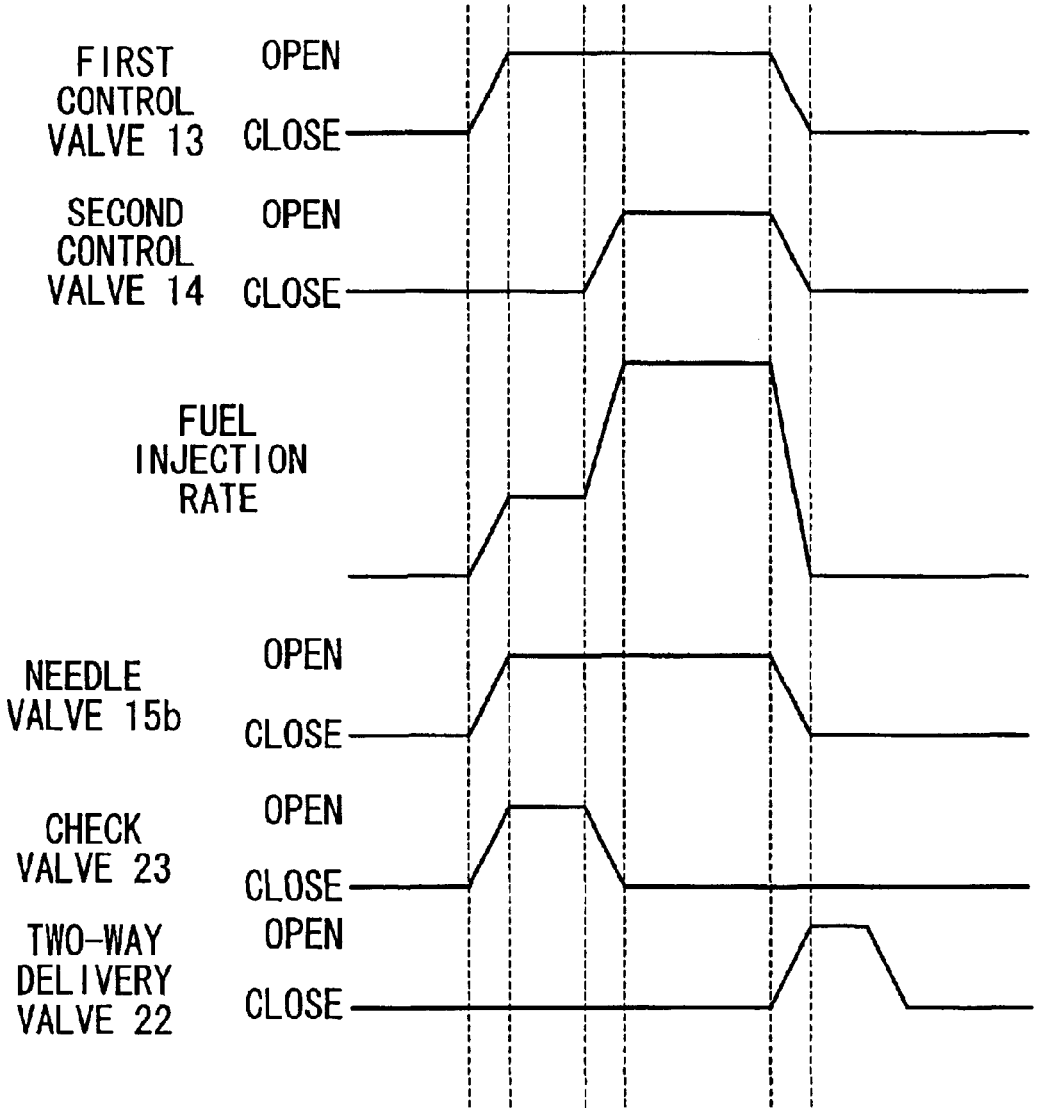
FIG. 16 is a figure showing the operating states of the fuel injector shown in FIG. 14 and shows the fuel injection rate change and the switching conditions of each control valve.

In the present embodiment, as shown in FIG. 14 and FIG. 15, the first accumulator 11, which is the low-pressure accumulator, accumulates fuel, for example, C heavy oil, pressurized, for example, to 60 MPa by the first pump 17, and the second accumulator 12, which is the high-pressure accumulator, accumulates fuel pressurized to, for example, 160 MPa, by the second pump 18. In addition, the fuel pressure in the drain discharge pipe 20 and the fuel feeding pipe 16 further upstream of the two-way delivery valve 22 is adjusted so as not to fall below, for example, 20 MPa, and the fuel injection valve 15 opens to supply fuel having a predetermined pressure, for example, a pressure equal to or greater than 45 Mpa, and thereby fuel is injected into the cylinder.

The operation of the fuel injector 10 in the present embodiment during the operation of the diesel engine 30 providing the fuel injector 10 described above will now be explained.

When the diesel engine 30 starts the fuel injection stroke, the first control valve 13 opens in advance, and the fuel accumulated in the low-pressure accumulator 11 is supplied to the fuel injection valve 15.

Next, the second control valve 14 opens a predetermined time interval after the opening of the first control valve 13, and the fuel accumulated in the high-pressure accumulator 12 is supplied to the fuel injection valve 15.

After completion of the fuel injection stroke, the first control valve 13 and the second control valve 14 close simultaneously.

In this manner, when the first control valve 13, which is the low-pressure control valve, is opened in advance, the fuel injection rate of the early period during the fuel injection is restricted to a low rate, and when the second control valve 14, which is the high-pressure control valve, is opened later, the fuel injection rate of the late period is increased. FIG. 16 shows the change in the fuel injection rate and the opened and closed condition of each valve in the present embodiment.

Therefore, the diesel engine 30 of the present embodiment also yields effects identical to those of the first embodiment described above.

Seventh Embodiment

Next, a seventh embodiment of the present invention will be explained with reference to FIG. 17 and FIG. 18. Moreover, essential components that have already been explained in the first embodiment have identical reference numerals, and their explanation has been omitted.

Figure 17:
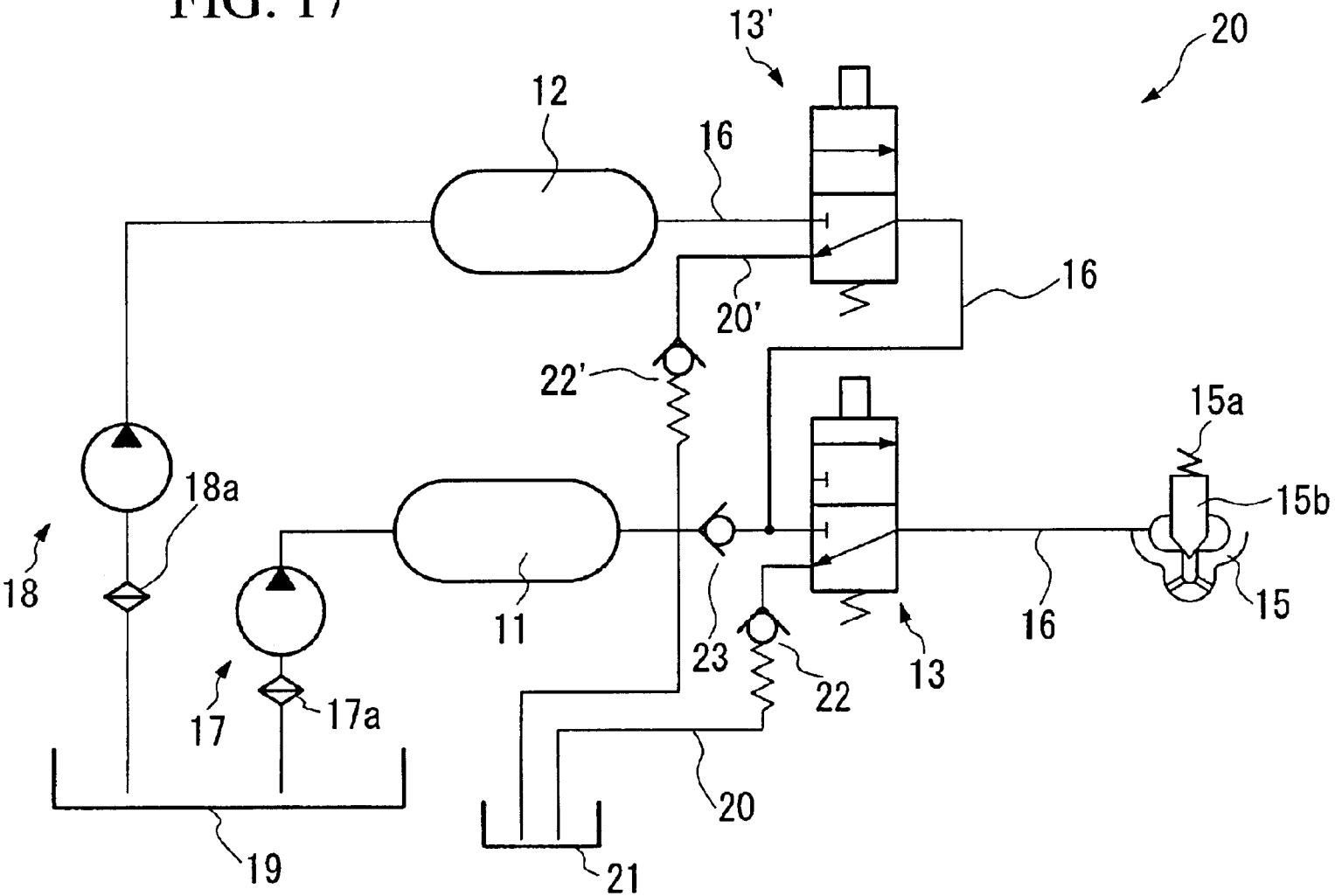
FIG. 17 is a schematic structural diagram showing the seventh embodiment of the fuel injector according to the present invention.
Figure 18:
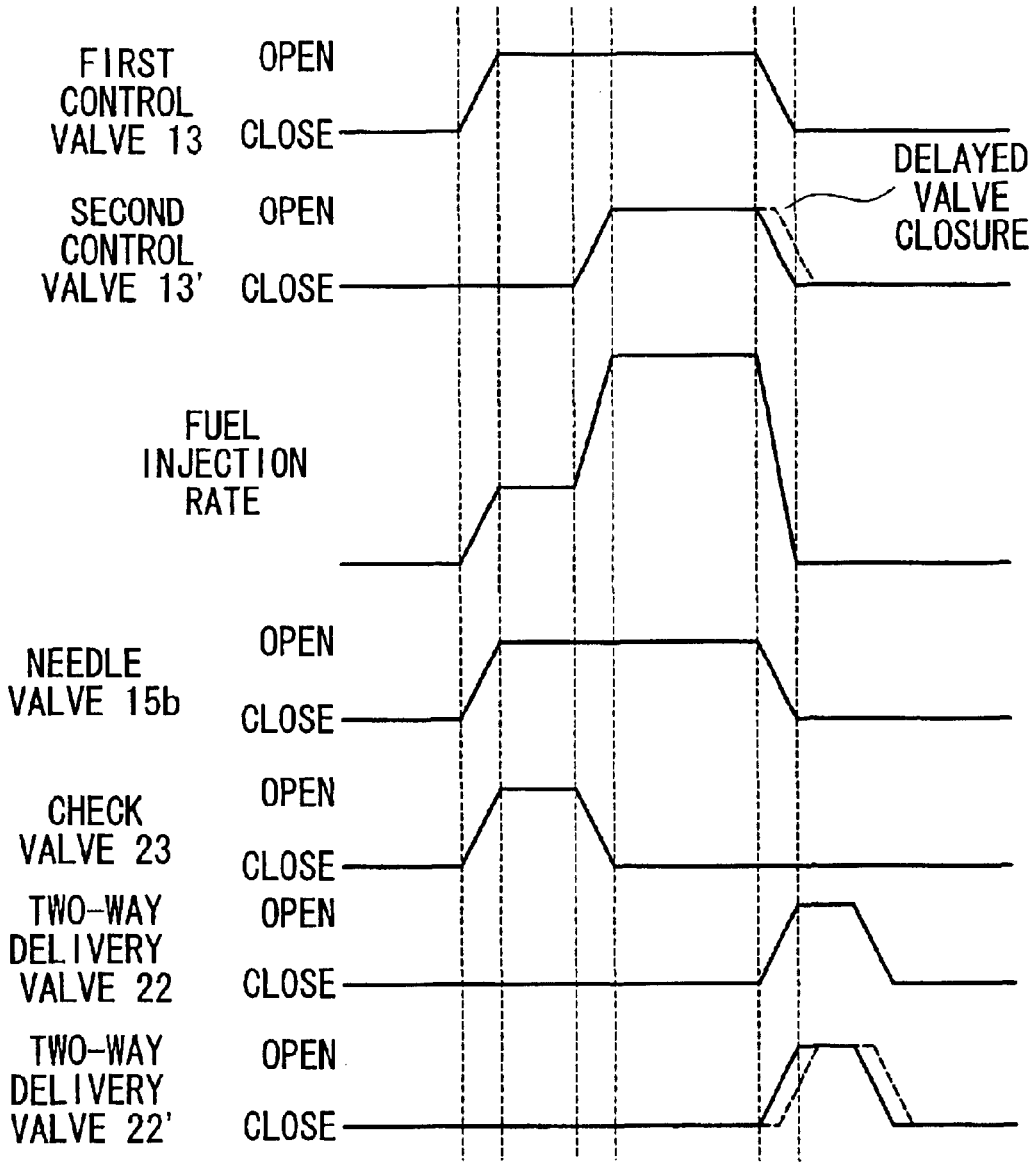
FIG. 18 is a figure showing the operating states of the fuel injector shown in FIG. 17 and shows the fuel injection rate change and the switching conditions of each control valve.

The seventh embodiment shown in FIG. 17 differs significantly from the sixth embodiment in the point that a three-way selector valve identical to the first control valve 13 shown in the sixth embodiment is used as the second control valve 13', which is the high-pressure control valve, and the point that the fuel feeding pipe 16 on the outlet side (the fuel injection valve 15 side) of the second control valve 13' is connected upstream in the direction of the flow of the fuel towards the first control valve 13, that is, between the check valve 23 and the first control valve 13.

Note that in the sixth embodiment, the fuel feeding pipe 16 on the outlet side of the second control valve 14 is connected downstream of the first control valve 13, that is, between the first control valve 13 and the fuel injection valve 15.

The second control valve 13' is connected to the fuel service tank 19 via the pipe 20'. Thereby, in the case in which the second control valve 13' stops the fuel supply to the fuel injection valve 15, the fuel that causes excess pressure due to it remaining in the fuel feeding pipe 16 on the fuel injection valve 15 side is recovered in the fuel drain tank 21 via the pipe 20'. Moreover, the two-way delivery valve 22 is also connected to the pipe 20', and the fuel pressure in the drain discharge pipe 20' farther upstream than the two-way delivery valve 22' and the fuel feeding pipe 16 is adjusted so as not to fall below, for example, 60 MPa.

The operation of the fuel injector 20 will now be explained when the diesel engine providing the fuel injector 20 described above is in operation.

When the diesel engine starts the fuel injection stroke, the first control valve 13 opens in advance of the second control valve 13', and the fuel in the first accumulator 11 is supplied to the fuel injection valve 15.

Next, the second control valve 13' opens at a predetermined time interval after the opening of the first control valve 13, and the fuel accumulated in the high-pressure accumulator 12 is supplied to the fuel injection valve 15.

After completion of the fuel injection stroke, the first control valve 13 and the second control valve 13' close simultaneously. Thereby, the fuel that causes excess pressure due to it remaining in the fuel feeding pipe 16 on the fuel injection valve 15 side is discharged via the drain discharge pipe 20 installed on the first control valve 13 and the drain discharge pipe 20' installed on the second control valve 13', and is recovered in the fuel drain tank 21.

In this manner, when the first control valve 13, which is for low-pressure fuel, is opened in advance, the fuel injection rate of the early period during the fuel injection is restricted to a low rate, and when the second control valve 14, which is for high-pressure fuel, is opened later, the fuel injection rate of the late period is increased. FIG. 18 shows the change in the fuel injection rate and the opened and closed condition of each valve in the present embodiment. From FIG. 18, it can be understood that effects identical to those of the first embodiment described above can be obtained.

Unlike the sixth embodiment described above, in the present embodiment, the first control valve 13 is positioned downstream of the fuel injection valve 15 of the second control valve 13', and thus, even if the second control valve 13' closes later than the first control valve 13, the supply of fuel to the fuel injection valve 15 can be completely stopped due to the closing of the first control valve 13.

Therefore, in the seventh embodiment, in addition to obtaining effects identical to those of the sixth embodiment, it is not always necessary for the first control valve 13 and the second control valve 13' to close simultaneously, and thus the second control valve 13' can be closed after the first control valve 13. Thereby, the effect is obtained that the opening and closing control of the first control valve 13 and the second control valve 13' can be simplified.

What is claimed is:

1. A fuel injector comprising:

a first accumulator for accumulating a pressurized fuel;

a second accumulator for accumulating a fuel having a higher pressure than the pressure of the fuel in the first accumulator;

fuel injection valves to which the fuel from the first and second accumulators is supplied and thereby the fuel injection valves are opened, and the fuel is injected;

fuel feeding pipes for feeding the fuel accumulated in the first and second accumulators to the fuel injection valves;

a first valve mechanism which is provided at the fuel feeding pipe and which opens and allows the flow of the fuel in the first accumulator to the fuel injection valves;

a second valve mechanism which is provided at the fuel feeding pipe and which opens and allows the flow of the fuel in the second accumulator to the fuel injection valves; and a control device for controlling the first and second valve mechanisms;

wherein the first accumulator and the first valve mechanism, and the second accumulator and the second valve mechanism are provided in parallel to each other to the fuel feeding pipe;

wherein in a normal injection mode, the control device makes the first and second valve mechanisms open at the same time; and wherein in an injection rate control mode, the control device makes an open timing of the first valve mechanism earlier than an open timing in the normal injection mode.

2. A fuel injector comprising:

a first accumulator for accumulating a pressurized fuel;

a second accumulator for accumulating a fuel having a higher pressure than the pressure of the fuel in the first accumulator;

fuel injection valves to which the fuel from the first and second accumulators is supplied and thereby the fuel injection valves are opened, and the fuel is injected;

fuel feeding pipes for feeding the fuel accumulated in the first and second accumulators to the fuel injection valves;

a first valve mechanism which is provided at the fuel feeding pipe and which opens and allows the flow of the fuel in the first accumulator to the fuel injection valves;

a second valve mechanism which is provided at the fuel feeding pipe and which opens and allows the flow of the fuel in the second accumulator to the fuel injection valves; and a control device for controlling the first and second valve mechanisms;

wherein the first valve mechanism is provided at the fuel feeding pipe downstream of the second valve mechanism in a flow direction of the fuel toward the fuel injection valves;

wherein in a normal injection mode, the control device makes the first and second valve mechanisms open at the same time; and wherein in an injection rate control mode, the control device makes an open timing of the first valve mechanism earlier than an open timing in the normal injection mode.

3. A fuel injector comprising:

a first accumulator for accumulating a pressurized fuel;

a second accumulator for accumulating a fuel having a higher pressure than the pressure of the fuel in the first accumulator;

fuel injection valves to which the fuel from the first and second accumulators is supplied and thereby the fuel injection valves are opened, and the fuel is injected;

fuel feeding pipes for feeding the fuel accumulated in the first and second accumulators to the fuel injection valves;

a first valve mechanism which is provided at the fuel feeding pipe and which opens and allows the flow of the fuel in the first accumulator to the fuel injection valves;

a second valve mechanism which is provided at the fuel feeding pipe and which opens and allows the flow of the fuel in the second accumulator to the fuel injection valves; and a control device for controlling the first and second valve mechanisms;

wherein the first accumulator and the first valve mechanism, and the second accumulator and the second valve mechanism are provided in parallel to each other to the fuel feeding pipe;

wherein in a normal injection mode, the control device makes the first and second valve mechanisms open at the same time; and wherein in an injection rate control mode, the control device makes an open timing of the second valve mechanism later than an open timing in the normal injection mode.

4. A fuel injector comprising:

a first accumulator for accumulating a pressurized fuel;

a second accumulator for accumulating a fuel having a higher pressure than the pressure of the fuel in the first accumulator;

fuel injection valves to which the fuel from the first and second accumulators is supplied and thereby the fuel injection valves are opened, and the fuel is injected;

fuel feeding pipes for feeding the fuel accumulated in the first and second accumulators to the fuel injection valves;

a first valve mechanism which is provided at the fuel feeding pipe and which opens and allows the flow of the fuel in the first accumulator to the fuel injection valves;

a second valve mechanism which is provided at the fuel feeding pipe and which opens and allows the flow of the fuel in the second accumulator to the fuel injection valves; and a control device for controlling the first and second valve mechanisms;

wherein the first valve mechanism is provided at the fuel feeding pipe downstream of the second valve mechanism in a flow direction of the fuel toward the fuel injection valves;

wherein in a normal injection mode, the control device makes the first and second valve mechanisms open at the same time; and wherein in an injection rate control mode, the control device makes an open timing of the second valve mechanism later than an open timing in the normal injection mode.

5. A fuel injector according to claim 1, wherein, during the injection rate control mode, the control device makes an open timing of the first valve mechanism earlier than the open timing in the normal injection mode; and the control device makes an open timing of the second valve mechanism later than an open timing in the normal injection mode.

6. A fuel injector according to claim 2, wherein, during the injection rate control mode, the control device makes an open timing of the first valve mechanism earlier than the open timing in the normal injection mode; and the control device makes an open timing of the second valve mechanism later than an open timing in the normal injection mode.

7. A fuel injector according to claim 1, wherein the control device makes the open timing of the first valve mechanism advance gradually.

8. A fuel injector according to claim 2, wherein the control device makes the open timing of the first valve mechanism advance gradually.

9. A fuel injector according to claim 5, wherein the control device makes the open timing of the first valve mechanism advance gradually.

10. A fuel injector according to claim 6, wherein the control device makes the open timing of the first valve mechanism advance gradually.

11. A fuel injector according to claim 3, wherein the control device makes the open timing of the second valve mechanism retard gradually.

12. A fuel injector according to claim 4, wherein the control device makes the open timing of the second valve mechanism retard gradually.

13. A fuel injector according to claim 5, wherein the control device makes the open timing of the second valve mechanism retard gradually.

14. A fuel injector according to claim 6, wherein the control device makes the open timing of the second valve mechanism retard gradually.

15. A fuel injector according to claim 1, wherein a pump for increasing the pressure of the fuel to a predetermined value is provided for each of the first and second accumulators.

16. A fuel injector according to claim 2, wherein a pump for increasing the pressure of the fuel to a predetermined value is provided for each of the first and second accumulators.

17. A fuel injector according to claim 3, wherein a pump for increasing the pressure of the fuel to a predetermined value is provided for each of the first and second accumulators.

18. A fuel injector according to claim 4, wherein a pump for increasing the pressure of the fuel to a predetermined value is provided for each of the first and second accumulators.

19. A fuel injector comprising:

a first accumulator for accumulating a pressurized fuel;

a second accumulator for accumulating a fuel having substantially the same pressure as the pressure of the fuel in the first accumulator;

fuel injection valves to which the fuel from the first and second accumulators is supplied and thereby the fuel injection valves are opened, and the fuel is injected;

fuel feeding pipes for feeding the fuel accumulated in the first and second accumulators to the fuel injection valves;

a first valve mechanism which is provided at the fuel feeding pipe and which opens and allows the flow of the fuel in the first accumulator to the fuel injection valves;

a fuel pressure reducing device for reducing the pressure of fuel which passes through the first accumulator and is supplied to the fuel injection valves;

a second valve mechanism which is provided at the fuel feeding pipe and which opens and allows the flow of the fuel in the second accumulator to the fuel injection valves; and a control device for controlling the first and second valve mechanisms and the fuel pressure reducing device;

wherein, in a normal injection mode, the control device makes the first valve mechanism open earlier than the second valve mechanism; and wherein in an injection rate control mode, the control device operates the fuel pressure reducing device, and thereby the pressure of the fuel passing through the first accumulator and supplied to the fuel injection valves is reduced.

20. A fuel injector comprising:

a first accumulator for accumulating a pressurized fuel;

a second accumulator for accumulating a fuel having substantially the same pressure as the pressure of the fuel in the first accumulator;

fuel injection valves to which the fuel from the first and second accumulators is supplied and thereby the fuel injection valves are opened, and the fuel is injected;

fuel feeding pipes for feeding the fuel accumulated in the first and second accumulators to the fuel injection valves;

a first valve mechanism which is provided at the fuel feeding pipe and which opens and allows the flow of the fuel in the first accumulator to the fuel injection valves;

a fuel pressure reducing device for reducing the pressure of fuel which passes through the first accumulator and is supplied to the fuel injection valves;

a second valve mechanism which is provided at the fuel feeding pipe and which opens and allows the flow of the fuel in the second accumulator to the fuel injection valves; and a control device for controlling the first and second valve mechanisms and the fuel pressure reducing device;

wherein, in a normal injection mode, the control device makes the first and second valve mechanisms open at the same time; and wherein in an injection rate control mode, the control device makes the open timing of the second valve mechanism later than the open timing in the normal injection mode, while the control device operates the fuel pressure reducing device, and thereby the pressure of the fuel passing through the first accumulator and supplied to the fuel injection valves is reduced.

21. A fuel injector according to claim 19, wherein the first valve mechanism is provided at the fuel feeding pipe downstream of the second valve mechanism in a flow direction of the fuel toward the fuel injection valves.

22. A fuel injector according to claim 20, wherein the first valve mechanism is provided at the fuel feeding pipe downstream of the second valve mechanism in a flow direction of the fuel toward the fuel injection valves.

23. A fuel injector according to claim 19, wherein the control device makes the open timings of the first and second valve mechanisms in the injection rate control mode earlier than those of the first and second valve mechanisms in the normal injection mode.

24. A fuel injector according to claim 20, wherein the control device makes the open timings of the first and second valve mechanisms in the injection rate control mode earlier than those of the first and second valve mechanisms in the normal injection mode.

25. A fuel injector according to claim 20, wherein the control device makes the open timing of the first valve mechanism in the injection rate control mode earlier than that of the first valve mechanism in the normal injection mode.

26. A fuel injector according to claim 22, wherein the control device makes the open timing of the first valve mechanism in the injection rate control mode earlier than that of the first valve mechanism in the normal injection mode.

27. A fuel injector according to claim 19, wherein the control device operates the fuel pressure reducing device, and thereby the pressure of the fuel is reduced gradually.

28. A fuel injector according to claim 20, wherein the control device operates the fuel pressure reducing device, and thereby the pressure of the fuel is reduced gradually.

29. A fuel injector according to claim 19, wherein a pump for increasing the pressure of the fuel to a predetermined value is provided for each of the first and second accumulators.

30. A fuel injector according to claim 20, wherein a pump for increasing the pressure of fuel to a predetermined value is provided for each of the first and second accumulators.

31. A fuel injector comprising:

at least one accumulator for accumulating a pressurized fuel;

fuel injection valves to which the fuel from the accumulator is supplied and thereby the fuel injection valves are opened, and the fuel is injected;

fuel feeding pipes for feeding the fuel accumulated in the accumulator to the fuel injection valves; and at least one valve which is provided at the fuel feeding pipe and which opens and allows the flow of the fuel in the accumulator to the fuel injection valves;

wherein a least one flow fuse comprising an excess flow check mechanism is provided between the accumulator and the valve.

32. A fuel injector according to claim 31, wherein the accumulator comprises a first accumulator for accumulating a pressurized fuel and a second accumulator for accumulating a fuel having a higher pressure than the pressure of the fuel in the first accumulator;

wherein the valve mechanism comprises a first valve mechanism which is provided at the fuel feeding pipe and which opens and allows the flow of the fuel in the first accumulator to the fuel injection valves and a second valve mechanism which is provided at the fuel feeding pipe and which opens and allows the flow of the fuel in the second accumulator to the fuel injection valves; and wherein the flow fuse is provided between the first accumulator and the first valve mechanism, and between the second accumulator and the second valve mechanism.

33. A fuel injector according to claim 31, wherein the accumulator, the valve mechanism, and the flow fuse comprise a unit.

34. A fuel injector according to claim 33, wherein the valve mechanism comprises one unit, and the unit comprising the valve mechanism is detachable from the unit comprising the accumulator and the flow fuse.

35. A fuel injector comprising:

at least one accumulator for accumulating a pressurized fuel;

fuel injection valves to which the fuel is supplied from the accumulator and thereby the fuel injection valves are opened, and the fuel is injected;

fuel feeding pipes for feeding the fuel accumulated in the accumulator to the fuel injection valves; and at least one valve mechanism which is provided at the fuel feeding pipe and which opens and allows the flow of the fuel in the accumulator to the fuel injection valves;

wherein the accumulator comprises at least two accumulators which accumulate fuel at different pressures;

wherein the valve mechanism is provided for each of the accumulators; and wherein the valve mechanisms provided for the accumulators accumulating fuel at different pressures are opened, in order of the lowness of the pressure of the fuel accumulated in the accumulators.

36. A fuel injector according to claim 35, wherein the valve mechanism for the accumulator accumulating fuel having the lowest pressure is provided at the fuel feeding pipe downstream of the other valve mechanisms in a flow direction of the fuel toward the fuel injection valves.

37. A fuel injector according to claim 35, wherein the accumulator comprises a first accumulator for accumulating a pressurized fuel and a second accumulator for accumulating a fuel having a higher pressure than the pressure of the fuel in the first accumulator; and wherein the valve mechanism comprises a first valve mechanism which is provided at the fuel feeding pipe and which opens and allows the flow of the fuel in the first accumulator to the fuel injection valves and a second valve mechanism which is provided at the fuel feeding pipe and which opens and allows the flow of the fuel in the second accumulator to the fuel injection valves.

38. A fuel injector according to claim 37, wherein the first valve mechanism is provided at the fuel feeding pipe downstream of the second valve mechanism in a flow direction of the fuel toward the fuel injection valves.

39. A fuel injector according to claim 35, wherein a pump for increasing the pressure of fuel to a predetermined value is provided for the accumulator.

40. A diesel engine comprising the fuel injector according to claim 1 and cylinder heads provided with the fuel injection valves.

41. A diesel engine according to claim 40, wherein the accumulators and the valve mechanisms are provided separately from the cylinder heads.

42. A diesel engine according to claim 41, wherein the diesel engine comprises a governor for detecting a load of the diesel engine, and the control device controls the valve mechanisms based on signals from the governor.

43. A diesel engine comprising the fuel injector according to claim 2 and cylinder heads provided with the fuel injection valves.

44. A diesel engine according to claim 43, wherein the accumulators and the valve mechanisms are provided separately from the cylinder heads.

45. A diesel engine according to claim 44, wherein the diesel engine comprises a governor for detecting a load of the diesel engine, and the control device controls the valve mechanisms based on signals from the governor.

46. A diesel engine comprising the fuel injector according to claim 3 and cylinder heads provided with the fuel injection valves.

47. A diesel engine according to claim 46, wherein the accumulators and the valve mechanisms are provided separately from the cylinder heads.

48. A diesel engine according to claim 47, wherein the diesel engine further comprises a governor for detecting a load of the diesel engine, and the control device controls the valve mechanisms based on signals from the governor.

49. A diesel engine comprising the fuel injector according to claim 4 and cylinder heads provided with the fuel injection valves.

50. A diesel engine according to claim 49, wherein the accumulators and the valve mechanisms are provided separately from the cylinder heads.

51. A diesel engine according to claim 50, wherein the diesel engine further comprises a governor for detecting a load of the diesel engine, and the control device controls the valve mechanisms based on signals from the governor.

52. A diesel engine comprising the fuel injector according to claim 19 and cylinder heads provided with the fuel injection valves.

53. A diesel engine according to claim 52, wherein the accumulators and the valve mechanisms are provided separately from the cylinder heads.

54. A diesel engine according to claim 53, wherein the diesel engine further comprises a governor for detecting a load of the diesel engine, and the control device controls the valve mechanisms and the fuel pressure reducing device based on signals from the governor.

55. A diesel engine comprising the fuel injector according to claim 20 and cylinder heads provided with the fuel injection valves.

56. A diesel engine according to claim 55, wherein the accumulators and the valve mechanisms are provided separately from the cylinder heads.

57. A diesel engine according to claim 56, wherein the diesel engine further comprises a governor for detecting a load of the diesel engine, and the control device controls the valve mechanisms and the fuel pressure reducing device based on signals from the governor.

58. A diesel engine comprising the fuel injector according to claim 31 and cylinder heads provided with the fuel injection valves.

59. A diesel engine according to claim 58, wherein the accumulator, the valve mechanism, and the flow fuse are provided separately from the cylinder heads.

60. A diesel engine comprising the fuel injector according to claim 35 and cylinder heads provided with the fuel injection valves.

61. A diesel engine according to claim 60, wherein the accumulator and the valve mechanism are provided separately from the cylinder heads.

62. A fuel injector according to claim 61, wherein the accumulator and the valve mechanism comprise a unit.

63. A fuel injector according to claim 62, wherein a flow fuse is provided between the accumulator and the valve mechanism, and the valve mechanism is detachable from the accumulator and the flow fuse.

* * * * *